US007179779B1

(12) United States Patent
Hauser et al.

(10) Patent No.: US 7,179,779 B1
(45) Date of Patent: Feb. 20, 2007

(54) CATIONIC BLEACH ACTIVATOR WITH ENHANCED HYDROLYTIC STABILITY

(75) Inventors: Peter J. Hauser, Raleigh, NC (US); David Hinks, Apex, NC (US); Jung Jin Lee, Raleigh, NC (US); Sang-Hoon Lim, Emeryville, CA (US)

(73) Assignee: North Carolina State University, Raleigh, NC (US)

( * ) Notice: Subject to any disclaimer, the term of this patent is extended or adjusted under 35 U.S.C. 154(b) by 0 days.

(21) Appl. No.: 11/327,643

(22) Filed: Jan. 6, 2006

(51) Int. Cl.

| | |
|---|---|
| ***C11D 3/28*** | (2006.01) |
| ***C11D 3/39*** | (2006.01) |
| ***C11D 3/395*** | (2006.01) |
| ***C11D 7/32*** | (2006.01) |
| ***C11D 7/54*** | (2006.01) |

(52) U.S. Cl. ..... 510/313; 510/321; 510/372; 510/376; 510/378; 510/500; 510/501; 510/504; 510/506; 8/111; 252/186.29; 252/186.31; 252/186.39; 548/543; 548/544; 548/545

(58) Field of Classification Search ..... None
See application file for complete search history.

(56) References Cited

U.S. PATENT DOCUMENTS 5,460,747 A * 10/1995 Gosselink et al. ..... 510/220
5,534,179 A * 7/1996 Miracle et al. ..... 510/305
5,686,015 A * 11/1997 Willey et al. ..... 252/186.39

* cited by examiner

*Primary Examiner*—Gregory R. Del Cotto
(74) *Attorney, Agent, or Firm*—Jenkins, Wilson, Taylor & Hunt, P.A.

(57) ABSTRACT

A novel cationic bleach activator having an enhanced hydrolytic stability is provided. The novel cationic bleach activator also leads to a reduction in strength loss of cotton fibers compared to conventional hot peroxide bleaching, and achieves this reduction in strength loss without a loss of whiteness. Bleaching compositions and detergent compositions comprising the novel cationic bleach activator also are provided. A method of bleaching cellulosic fibers, such as cotton fibers, and a method for removing a stain or discoloration from an article are further provided.

30 Claims, 7 Drawing Sheets

CATIONIC BLEACH ACTIVATOR WITH ENHANCED HYDROLYTIC STABILITY

TECHNICAL FIELD

The presently disclosed subject matter relates to a cationic bleach activator. More particularly, the presently disclosed subject matter relates to a cationic bleach activator with enhanced hydrolytic stability.

| ABBREVIATIONS | |
|---|---|
| AATCC = | American Association of Textile Chemists and Colorists |
| ADD = | automatic dishwashing |
| AU = | Anson units |
| AvO = | available oxygen |
| ° C. = | degrees Celsius |
| CQSBA = | conventional quaternary substituted bleach activators |
| g = | grams |
| HPLC = | high performance liquid chromatography |
| L = | liters |
| m = | meters |
| M = | molar |
| min = | minutes |
| mL = | milliliters |
| NOBS = | nonanoyloxybenzene sulfonate |
| μL = | microliters |
| mol = | moles |
| NMR = | nuclear magnetic resonance |
| ppm = | parts-per-million |
| TAED = | tetracetylethylenediamine |
| TBA = | N-4-(triethylammoniomethyl) benzoic acid |
| TBCC = | N-[4-(triethylammoniomethyl) benzoyl]caprolactam chloride |
| WI = | whiteness index |
| w/w = | weight-in-weight |

BACKGROUND

Bleaching is a critical textile wet process that is commonly required for removing yellowish natural impurities from cotton fibers prior to dyeing and finishing. One of the most common bleaching methods for cotton fibers utilizes hot hydrogen peroxide bleaching under alkaline conditions. This process, however, is energy intensive and can chemically damage the cotton fibers.

Bleach activators are peracid precursors, which generate peracids in situ in the presence of hydrogen peroxide and alkali during a bleaching process. Typically, peracids are more reactive bleaching species than hydrogen peroxide and therefore can be used for bleaching at reduced temperatures. Bleach activators can be used in a variety of applications, including, but not limited to, home and industrial laundry usages, see A. P. James and I. S. MacKirdy, *Chem. Ind.,* 15 (1990) 641; K. Grime and A. Clauss, *Chem. Ind.,* 15 (1990) 647; and R. J. McLean, *Text. Chem. Colorist Am. Dyestuff Rep.,* 1 (1999) 42, and industrial textile preparation processes, see S. J. Scarborough and A. J. Mathews, *Text. Chem. Colorist Am. Dyestuff Rep.,* 32 (2000) 33; J. Y. Cai et al., *AATCC Rev.,* 1 (2001) 31; and J. Wang and N. M. Washington, *AATCC Rev.,* 2 (2002) 21. Nonanoyloxybenzene sulfonate (NOBS) and tetracetylethylenediamine (TAED) are two of the most widely used commercial bleach activators.

Cationic bleach activators provide affinity for the negatively charged surface of cotton in an aqueous solution and offer increased bleaching efficiency when compared to anionic bleach activators. Cationic bleach activators can be applied in a cold pad-batch and a hot peroxide bleaching process of cotton. See S. Lim, N. C. Gürsoy, P. Hauser and D. Hinks, *Color. Technol.,* 120 (2004) 114. In particular, N-[4-(triethylammoniomethyl)benzoyl]caprolactam chloride (TBCC) has been shown to exhibit satisfactory bleaching performance in a shorter time and at lower temperatures than conventional peroxide bleaching. Id. In some cases, however, cationic bleach activators, such as TBCC, are unstable and can be readily hydrolyzed in aqueous solution. Such instability in aqueous solution is a significant drawback in industrial applications in which the cationic bleach activator cannot be stored in aqueous solution even for a short period of time. See J. J. Lee, S. Lim, P. Hauser and D. Hinks, *Color. Technol.* 121 (2005) 37. Thus, there is a long-felt need in the art for cationic bleach activators that are stable in aqueous solutions, while providing satisfactory bleaching performance.

SUMMARY

In some embodiments, the presently disclosed subject matter provides a cationic bleach activator of Formula (I):

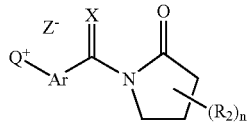

(I)

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent.

In some embodiments, the novel cationic bleach activator of Formula (I) has the following chemical structure:

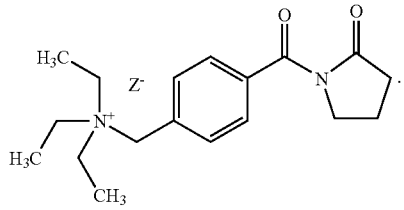

The presently disclosed cationic bleach activator exhibits an improved hydrolytic stability in aqueous solution when compared to cationic bleach activators known in the art. Further, the presently disclosed cationic bleach activator enables more efficient bleaching compared to bleaching processes where no activator is present. The presently disclosed cationic bleach activator also leads to a reduction in strength loss of cotton fibers compared to conventional hot peroxide bleaching, and achieves this reduction in strength loss without a loss of whiteness.

The presently disclosed cationic bleach activator can be applied directly to a conventional bleaching process without changing the bleaching facility. Further, the presently disclosed cationic bleach activator can be used (a) in the oxidation (destruction) of dye in residual dyehouse effluent; (b) as a bleaching aid in other cellulosic materials, such as paper; and (c) as a benign bleaching agent for chemically sensitive materials, such as wool, manmade cellulosic fibers, such as TENCEL® (Lenzing Fibers Ltd., Derby, United Kingdom), and fiber blends.

The presently disclosed bleach activator also can be used in a cleaning product. Accordingly, bleaching compositions and detergent compositions comprising the presently disclosed novel cationic bleach activator can be formulated and used to bleach cellulosic fibers, including, but not limited to cotton and paper, and to remove stains or discoloration from an article, such as a fabric, dishware, and a hard surface.

Thus, it is an object of the presently disclosed subject matter to provide a cationic bleach activator of Formula (I).

It is another object of the presently disclosed subject matter to provide a bleaching composition comprising an effective amount of a composition comprising a source of hydrogen peroxide; and an effective amount of a cationic bleach activator of Formula (I).

It is another object of the presently disclosed subject matter to provide a detergent composition comprising an effective amount of a cationic bleach activator of Formula (I).

It is another object of the presently disclosed subject matter to provide a method for bleaching a cellulosic fiber.

It is another object of the presently disclosed subject matter to provide a method for bleaching a chemically sensitive material.

It is another object of the presently disclosed subject matter to provide a method for removing a stain or discoloration from an article.

It is another object of the presently disclosed subject matter to provide a method for oxidizing a dye in a residual dyehouse effluent Certain objects of the presently disclosed subject matter having been stated hereinabove, which are addressed in whole or in part by the presently disclosed subject matter, other objects and aspects will become evident as the description proceeds when taken in connection with the accompanying Examples as best described hereinbelow.

DETAILED DESCRIPTION

Figure 1:
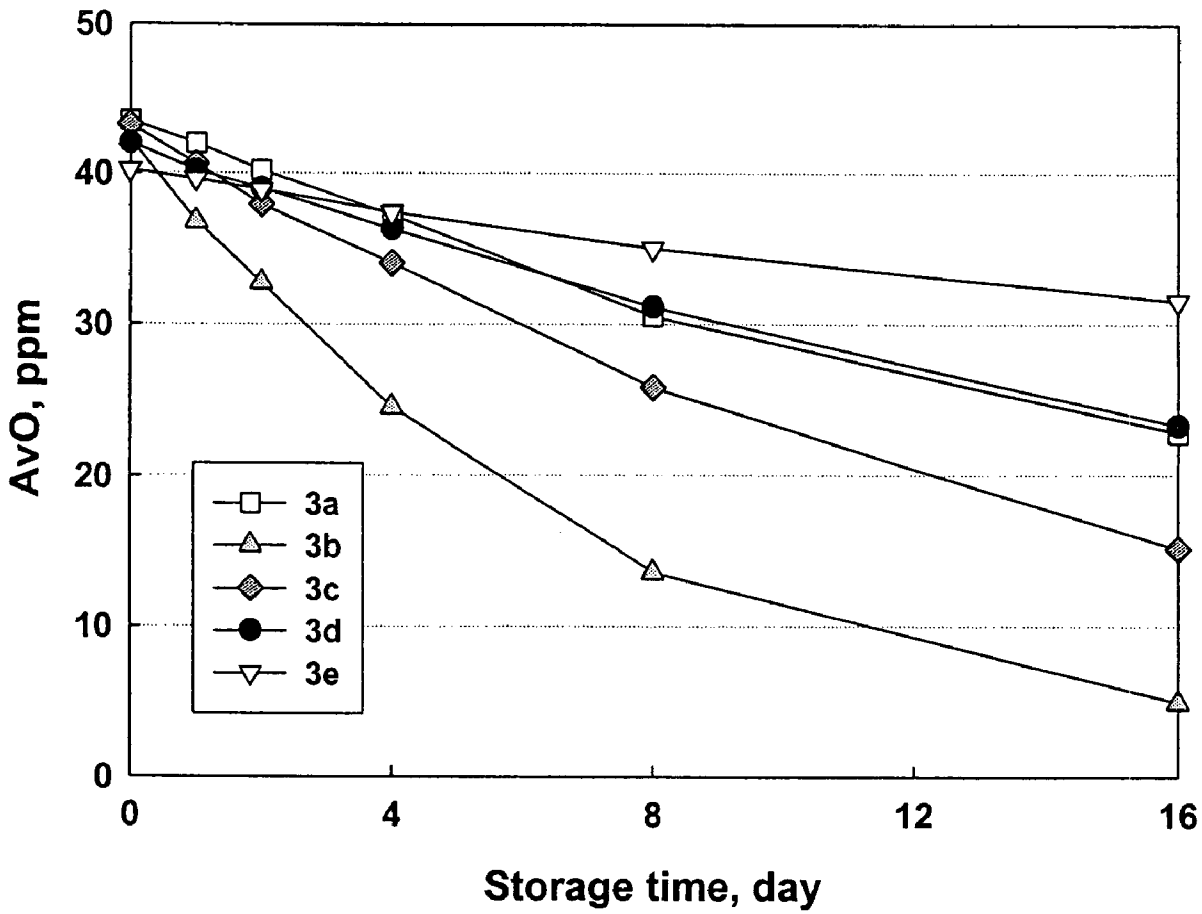
FIG. 1 shows the available oxygen (AvO) changes of aqueous solutions of the presently disclosed cationic bleach activators 3*a*–3*e* over a period of storage time.

The presently disclosed subject matter will now be described more fully hereinafter with reference to the accompanying Examples, in which representative embodiments are shown. The presently disclosed subject matter can, however, be embodied in different forms and should not be construed as limited to the embodiments set forth herein. Rather, these embodiments are provided so that this disclosure will be thorough and complete, and will fully convey the scope of the embodiments to those skilled in the art.

Unless otherwise defined, all technical and scientific terms used herein have the same meaning as commonly understood by one of ordinary skill in the art to which this presently described subject matter belongs. All publications, patent applications, patents, and other references mentioned herein are incorporated by reference in their entirety.

I. Novel Cationic Bleach Activators

In some embodiments, the presently disclosed subject matter provides a cationic bleach activator of Formula (I):

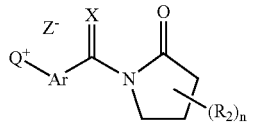

(I)

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent.

In some embodiments, the quaternary nitrogen group, $Q^+$, is:

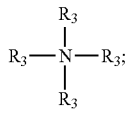

wherein each $R_3$ is independently selected from the group consisting of H, alkyl, substituted alkyl, branched alkyl, cycloalkyl, alkylene, hydroxyalkyl, alkoxyalkyl, aryl, substituted aryl, aralkylene, and aralkyl, or two or more $R_3$ groups together represent a alkyl, aralkyl, alkylene, or aralkyene group; provided that at least one $R_3$ group is an alkylene or aralkylene group that is covalently attached to the Ar moiety of the compound of Formula (I).

Accordingly, the quaternary nitrogen is substituted with four substituent groups, including one group that further serves to attach the quaternary nitrogen to the Ar group of the compound of Formula (I). In some embodiments, the substituted alkyl or aryl group of the quaternary nitrogen can include an ionizable group, such as, for example a sulfonic acid.

In some embodiments, two or more of the $R_3$ groups together represent an alkyl or aralkyl group. Thus, the compounds of Formula (I) can include structures including, but not limited to:

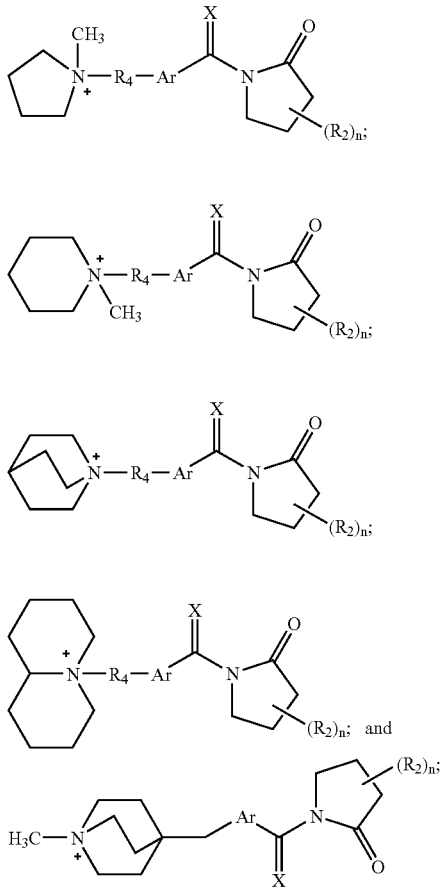

wherein $R_4$ is alkylene.

In some embodiments, X is O, three of the $R_3$ groups are alkyl and one $R_3$ group is alkylene, and the cationic bleach activator has the following chemical structure:

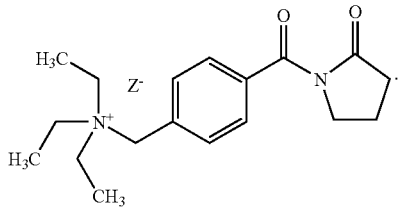

Thus, in some embodiments, the presently disclosed cationic bleach activator is N-[4-(triethylammoniomethyl)benzoyl] butyrolactam chloride.

In some embodiments, the presently disclosed cationic bleach activators comprise charge-balancing compatible anions or "counter-ions," identified as "$Z^-$" in the bleach activators herein. In some embodiments, the anion is selected from the group consisting of a halogen, such as bromide or chloride, and a phosphate. In some embodiments, however, it might be preferable not to use a halogen or a phosphate anion due to bleach reactivity or phosphorus content. Accordingly, in some embodiments, compatible anions are selected from the group consisting of sulfate, isethionate, alkanesulfonate, alkyl sulfate, aryl sulfonate, alkaryl sulfonate, carboxylates, polycarboxylates, and combinations thereof. In some embodiments, anions include the sulfonates selected from the group consisting of methanesulfonate, ethanesulfonate, benzenesulfonate, p-toluenesulfonate, cumenesulfonate, xylenesulfonate, naphthalene sulfonate and combinations thereof. In some embodiments, the sulfonates have an aryl moiety. In some embodiments, the alkyl sulfates include methyl sulfate and octyl sulfate. Polycarboxylate anions suitable herein are nonlimitingly illustrated by terephthalate, polyacrylate, polymaleate, poly (acrylate-comaleate), or similar polycarboxylates; preferably such polycarboxylates have low molecular weights, e.g., 1,000–4,500. Suitable monocarboxylates are further illustrated by benzoate, naphthoate, p-toluate, and similar hard-water precipitation-resistant monocarboxylates.

II. Hydrolytic Stabilities of the Presently Disclosed Cationic Bleach Activators In some embodiments, the presently disclosed cationic bleach activators are more stable than TBCC in aqueous solution, while maintaining satisfactory bleaching performance. Without wishing to be bound to any one particular theory, the presently disclosed subject matter suggests that the rate of hydrolysis is related to the identity of the leaving group of the bleach activator.

Representative chemical structures of the presently disclosed cationic bleach activators are provided in Scheme I.

Scheme 1. Representative Chemical Structures of the Presently Disclosed Cationic Bleach Activators.

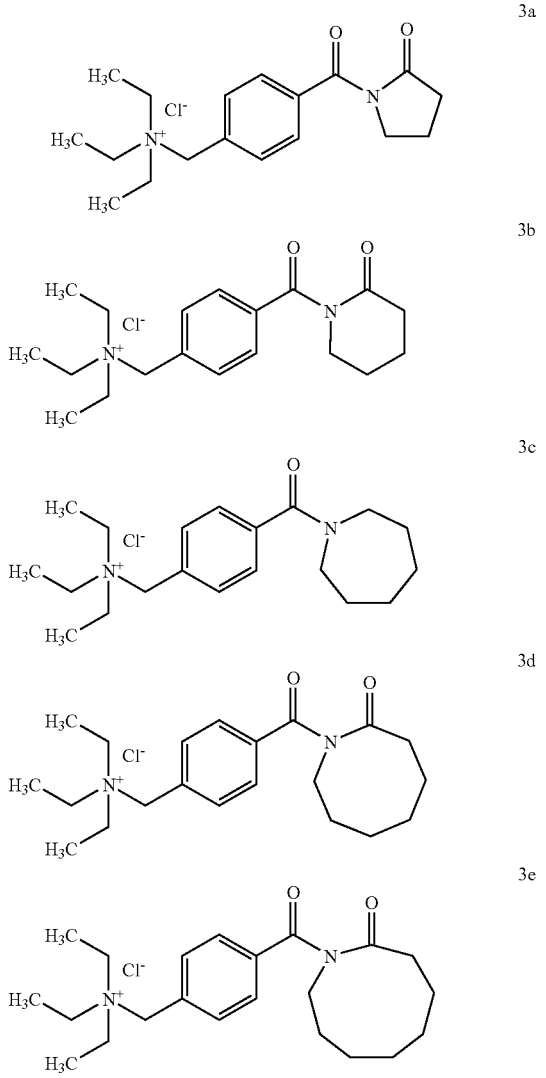

II.A. AvO Changes of Cationic Bleach Activator Solutions Over Time

The hydrolytic stabilities of the representative cationic bleach activators were evaluated by measuring available oxygen (AvO) of the cationic bleach activator solutions, as well as the resultant whiteness values of bleached cotton fabrics after storage of the solutions. The hydrolysis kinetics of the presently disclosed bleach activators also was studied using HPLC analysis.

Active or available oxygen (AvO) is a useful parameter for assessing the oxidizing power of hydrogen peroxide or peracids from bleach activators. See *American Standard Test Method* D 2180–89 (West Conshohocken: ASTM International, 2003); and J. K. Grime, A. D. Clauss and K. A. Leslie, *Tenside Surf. Det.,* 29 (1992) 23. A modified iodometric titration method was used to measure the AvO of the presently disclosed bleach activators. See J. J. Lee, S. Lim, P. Hauser and D. Hinks, *Color. Technol.,* 121 (2005) 37.

Referring now to FIG. 1, the AvO changes of the aqueous solutions of cationic bleach activators 3*a*–3*e* are shown as a function of time. On the initial day, the AvO of all the solutions was high (40.2–43.5), which suggests that the presently disclosed cationic bleach activators have good oxidizing and/or bleaching powers. The AvO decreased as storage time increased, however, which can likely be attributed to the hydrolysis reaction of the cationic bleach activator. See Scheme 2.

Scheme 2. Hydrolysis reactions of cationic bleach activators (3a-3e)

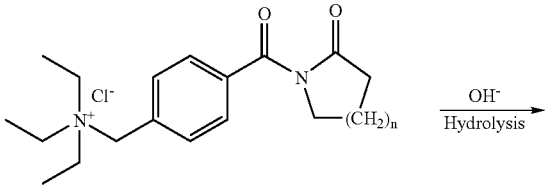

3a-3e

-continued

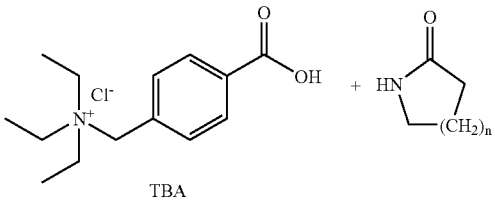

TBA

Referring once again to Scheme 2, N-4-(triethylammoniomethyl) benzoic acid (TBA) is believed to be produced by the hydrolysis reaction. TBA, however, does not have an oxidizing power, which results in a reduction of AvO. Without wishing to be bound to any one particular theory, the rate of decrease of AvO over time appears to depend on the leaving group of the cationic bleach activator. Thus, the AvO of 3*b*, which has valerolactam (a 6-membered ring) as a leaving group, decreased the fastest, suggesting that its rate of hydrolysis should be the greatest. The rate of AvO decrease of 3*c* or TBCC, which has caprolactam (a 7-membered ring) as a leaving group was second to that of 3*b*, followed by those of 3*a* (butyrolactam, a 5-membered ring) and 3*d* (heptalactam, a 8-membered ring) showing a similar trend to each other. Finally, the AvO of 3*e*, which has an octalactam (a 9-membered ring) leaving group decreased the slowest. Again, without wishing to be bound to any one particular theory, this result can be explained by considering that valerolactam and caprolactam are good leaving groups, while octalactam is a relatively poor leaving group. Thus, the carbon atom attached to the bulky octalactam moiety appears to be sterically blocked from attack by an $OH^-$ ion.

II.B. pH Changes of Cationic Bleach Activator Solutions Over Time

Figure 2:
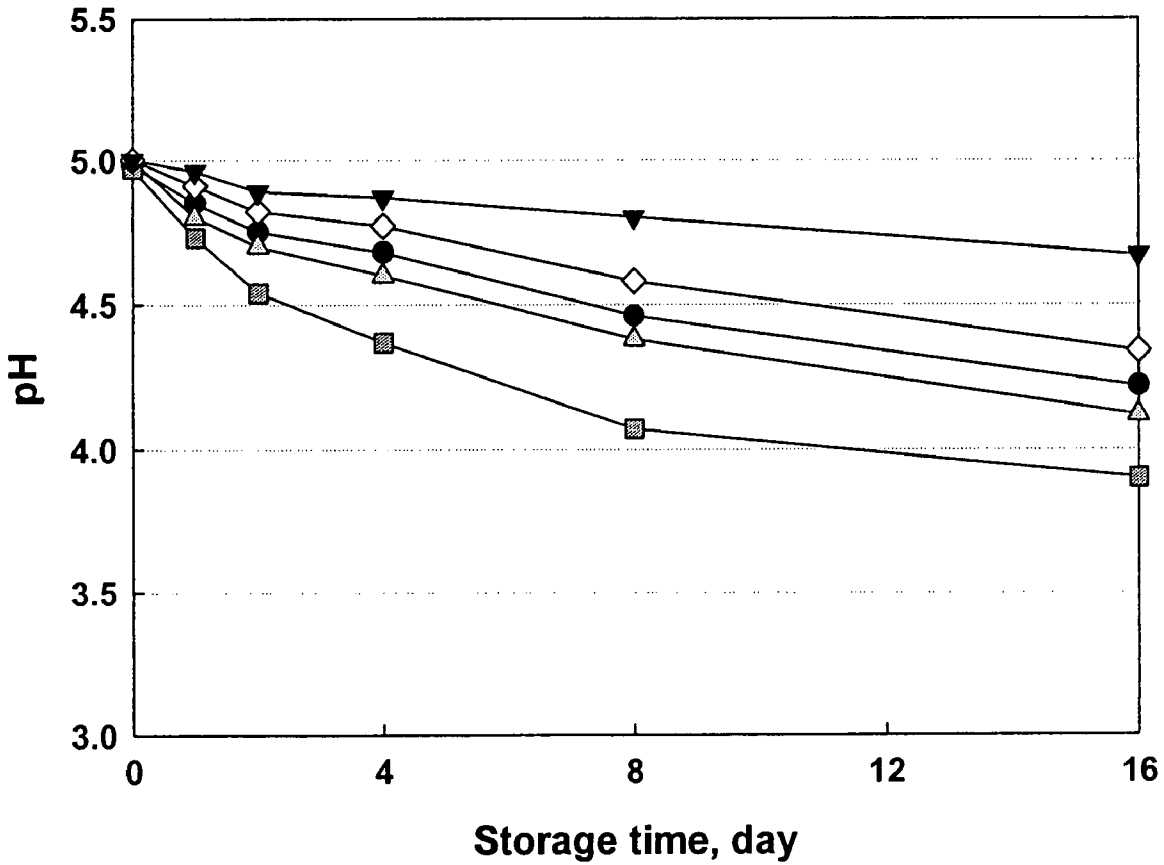
FIG. 2 shows pH changes of aqueous solutions of the presently disclosed cationic bleach activators 3*a*–3*e* over a period of storage time. (For key see FIG. 1).

Referring now to FIG. 2, the pH changes of aqueous solutions of the presently disclosed cationic bleach activators 3*a*–3*e* are shown. The pH values of each solution on the initial day were identical, e.g., a pH of 5. The pH values, however, decreased steadily with respect to time. This observation is believed to be due to the formation of acid (TBA) from the hydrolysis reaction. The trend of decreasing pH values for 3*a*–3*e* over time was similar to that of the changes in AvO for 3*a*–3*e* over time.

II.C. Hydrolysis Kinetics of Cationic Bleach Activator Solutions

The AvO changes and pH changes of the presently disclosed cationic bleach activator solutions suggest that the cationic bleach activators are hydrolyzed under typical storage conditions (e.g., a pH of 5, room temperature) as shown in Scheme 2 hereinabove and that the rate of hydrolysis is dependent on the leaving group of the bleach activators. The hydrolysis behaviors of the presently disclosed cationic bleach activators 3*a*–3*e* during storage were investigated further by using HPLC analysis.

Because the concentration of hydroxide ion, $OH^-$, in the cationic bleach activator solution is almost constant by using a buffer (pH 5), the decrease in the concentration of bleach activator can be expressed as equation 1:

$$-\frac{d[C]}{dt} = k[C] \quad \text{(eq. 1)}$$

wherein, [C] is the concentration of bleach activator at time t and k is the pseudo first order rate constant of hydrolysis. See M. B. Smith and J. March, *March's Advanced Organic Chemistry: Reactions, Mechanisms, and Structure,* $5^{th}$ ed. (New York: Wiley, 2001) 291.

Equation 2 then can be derived from equation 1:

$$\ln\left(\frac{C_o}{C_t}\right) = kt \quad \text{(eq. 2)}$$

wherein, $C_0$ and $C_t$ are the concentration of bleach activator at initial time and time t, respectively.

The parent cationic bleach activators 3*a*–3*e* and their hydrolyzed form (TBA) can be detected over time by HPLC analysis. Table 1 shows the retention times of the presently disclosed cationic bleach activators 3*a*–3*e* and TBA. As presented in Table 1, the larger the ring size of the leaving group of the bleach activator, the longer the retention time. Generally, a more polar component has a more rapid elution rate in reverse-phase chromatography. See D. A. Skoog, F. J. Holler and T. A. Nieman, *Principles of Instrumental Analysis,* $5^{th}$ ed. (Stamford: Brooks Cole, 1998), 739. Thus, a bleach activator with a large aliphatic leaving group is a less polar compound and its retention time is longer when compared with a bleach activator with a small leaving group. The retention time of the hydrolyzed form of each of the presently disclosed cationic bleach activators 3*a*–3*e* was identical because the hydrolysis reactions of each bleach activator would produce the same hydrolysis product, TBA.

TABLE 1

Retention times of the presently disclosed cationic bleach activators 3a–3e and their hydrolysis products 3a'–3e' (TBA) formed by the hydrolysis of 3a–3e.

| Compound | Retention time (min) | | | | |
|---|---|---|---|---|---|
| Activator | 3a | 3b | 3c | 3d | 3e |
| | 7.01 | 7.75 | 8.49 | 9.08 | 9.97 |
| Hydrolyzed form (TBA) | 3a' | 3b' | 3c' | 3d' | 3e' |
| | 6.06 | 6.09 | 6.05 | 6.05 | 6.08 |

Figure 3:
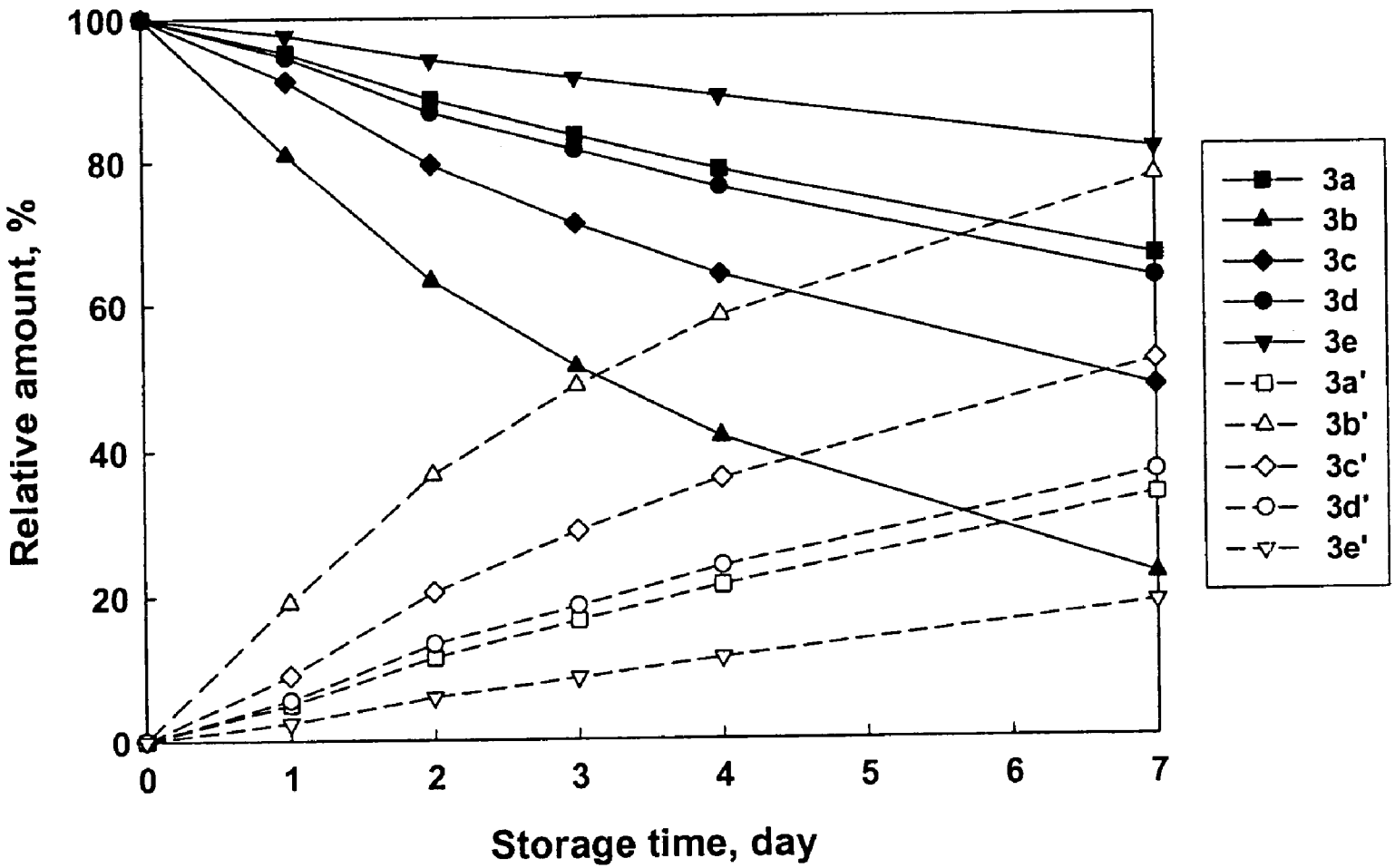
FIG. 3 shows the change in the amount of the presently disclosed cationic bleach activators 3*a*–3*e* and the hydrolysis product ((N-4-(triethylammoniomethyl) benzoic acid (TBA), 3*a*'–3*e*') formed by the hydrolysis of 3*a*–3*e* over storage time.

Referring now to FIG. 3 the hydrolysis behaviors of the presently disclosed cationic bleach activators 3*a*–3*e* over storage time is shown. On the initial day, each of the presently disclosed bleach activators exists in its parent (unhydrolyzed) form, i.e., having leaving groups, e.g., a lactam ring, in their structures. As the storage time increased, the amount of parent (unhydrolyzed) form decreased while that of the hydrolyzed form, e.g., TBA, increased. As expected from the results observed in the AvO change, the rate of hydrolysis was dependent on the leaving group of the cationic bleach activator.

Figure 4:
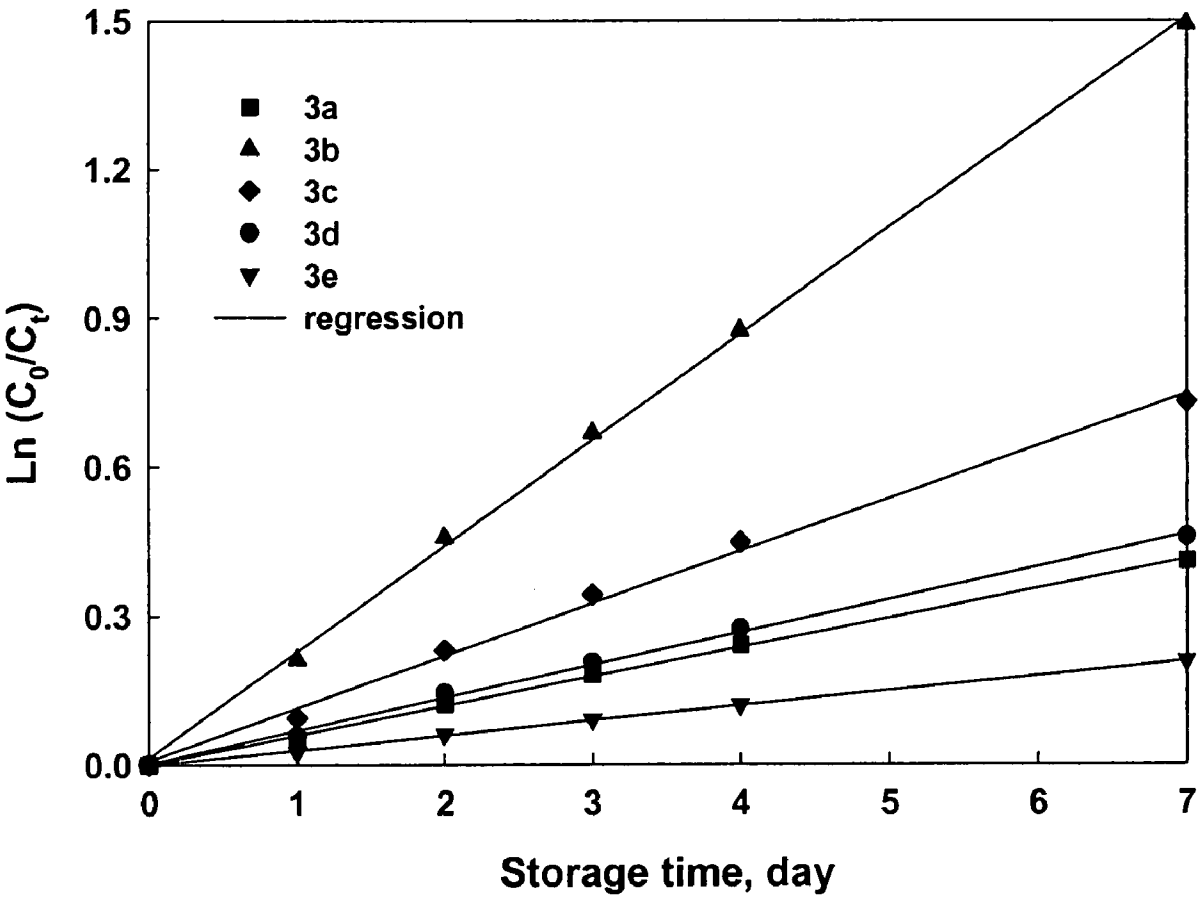
FIG. 4 is a plot of $\ln(C_0/C_t)$ versus storage time for the presently disclosed cationic bleach activators 3*a*–3*e*.

Referring now to FIG. 4, a plot of $\ln(C_0/C_t)$ against storage time t for each bleach activator is shown. A straight line was obtained in each case, confirming that the hydrolysis of the bleach activators follows pseudo first order reactions. The slope of the plot was calculated using a linear regression method to determine the pseudo first order rate constant. From the regression, $R^2$ values from 0.996 to 0.999 were obtained for each of the presently disclosed bleach activators.

Figure 5:
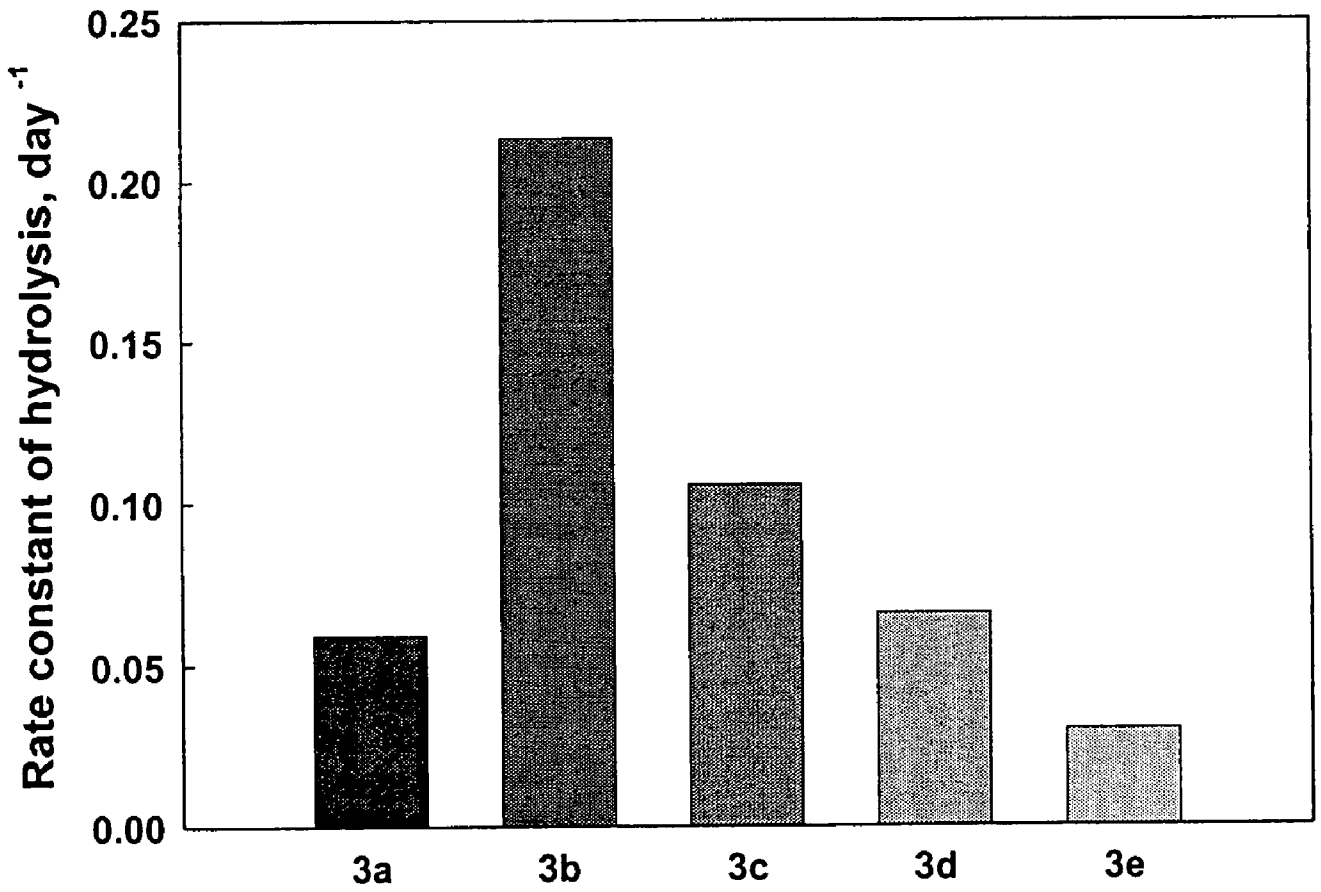
FIG. 5 shows the pseudo first order rate constants for the hydrolysis of the presently disclosed cationic bleach activators 3*a*–3*e* under typical storage conditions (e.g., pH of 5, room temperature).

Referring now to FIG. 5, the pseudo first order rate constants of hydrolysis of the presently disclosed cationic bleach activators 3*a*–3*e* are shown. Under typical storage conditions (e.g., 10% solution, a pH of 5, room temperature), the rate constant of the hydrolysis of 3*b* was greatest and two times greater than that of 3*c* or TBCC. The rate constants of 3*a*, 3*d* and 3*e* were smaller than that of TBCC. Thus, these results indicate that 3*a*, 3*d* and 3*e* are more stable than TBCC under typical storage conditions and that 3*e* is the most stable compound. The rate constant of hydrolysis of 3*e* was about 3 times smaller than that of 3*a* and 7 times smaller than that of TBCC. These results are consistent with those observed for AvO and pH changes and suggest that the hydrolytic stability of the cationic bleach activator is dependent on its leaving group.

II.D. Bleaching of Cotton with Cationic Bleach Activators

Figure 6:
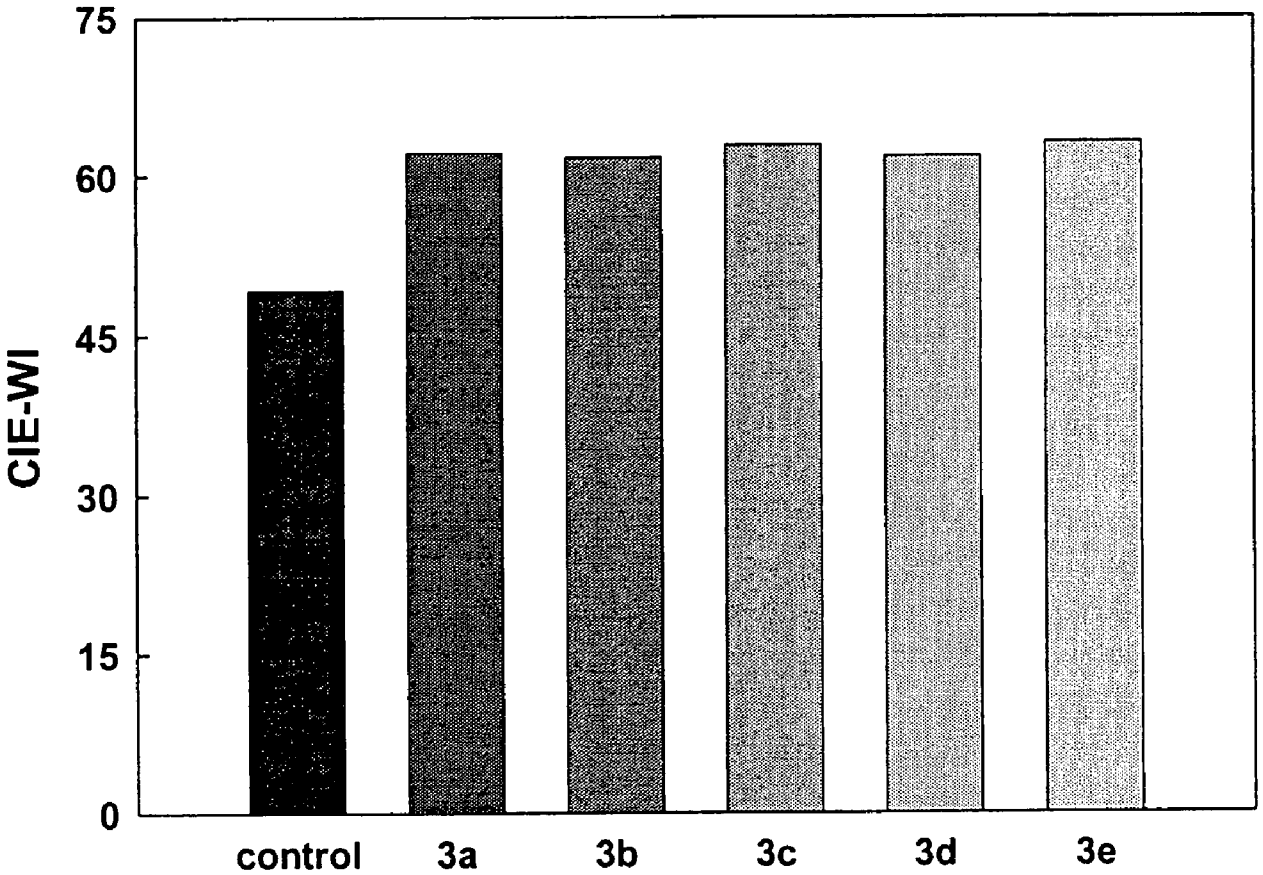
FIG. 6 shows the whiteness index (CIE-WI) of cotton fabric bleached with and without the presently disclosed cationic bleach activators 3*a*–3*e* (6 mmol/L) (bleaching at 70° C. for 50 min).

Referring now to FIG. 6, the CIE-whiteness index (CIE-WI) values of cotton fabrics bleached with the presently disclosed cationic bleach activators 3*a*–3*e* in a solid powder form are shown. An approximate commercial recipe was used for bleaching of cotton except that the optical brightening agent was omitted to investigate the effect of the presently disclosed bleach activators on the whiteness values. In each case, the CIE-WI value of cotton fabric bleached with a bleach activator was greater than 60 and greater than that of a control fabric (e.g., 49.1) that was bleached without using the activator. These results demonstrate that the presently disclosed cationic bleach activators have good bleaching powers.

Figure 7:
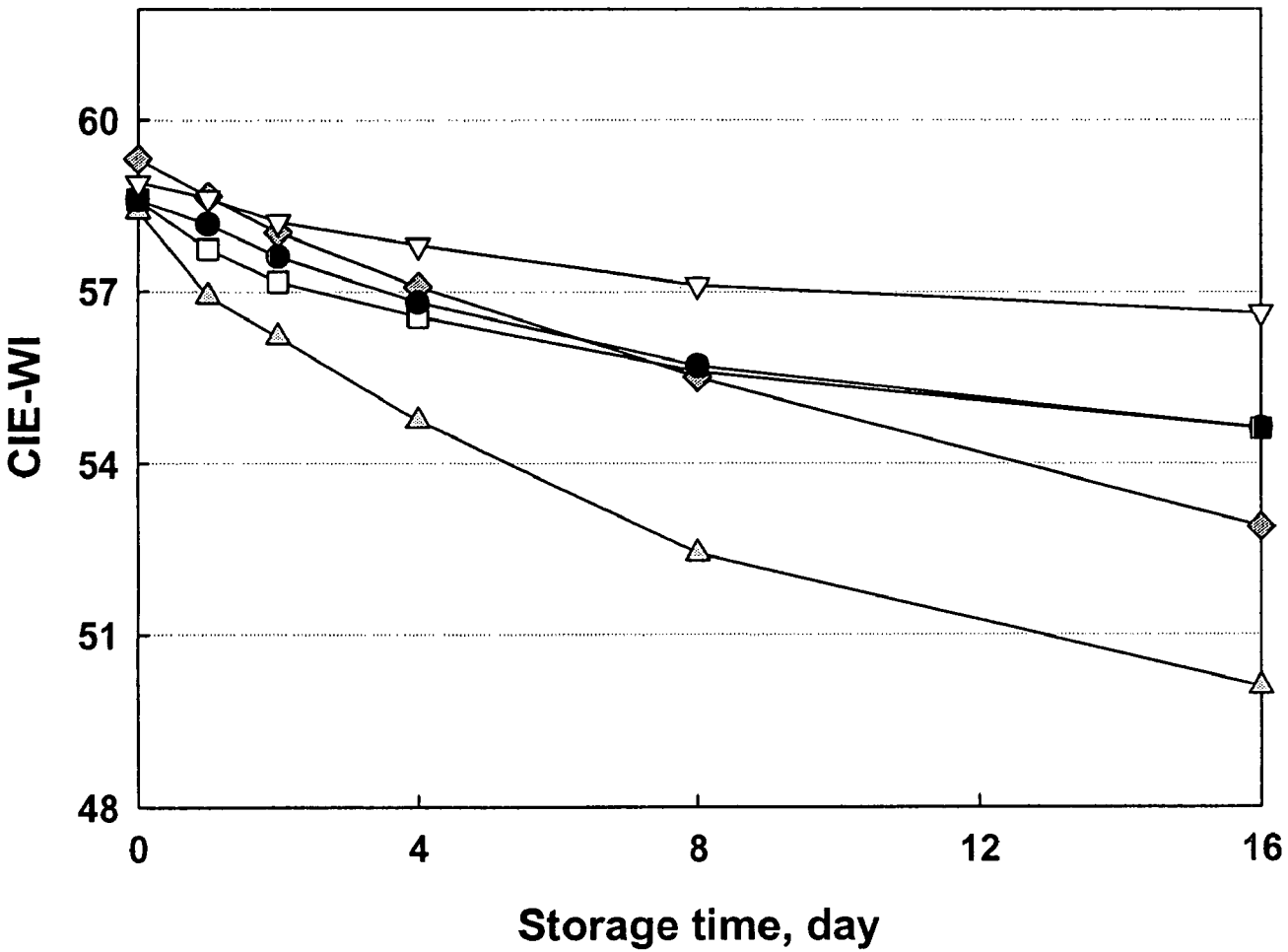
FIG. 7 shows the CIE-WI of cotton fabric bleached with aqueous solutions of the presently disclosed cationic bleach activators 3*a*–3*e* stored over a period of time. (For key see FIG. 1).

Referring now to FIG. 7, the effect of storage time on the CIE-WI values of cotton fabrics bleached with the cationic bleach activators 3*a*–3*e* is shown. As expected from the results of the HPLC analysis, as well as the observations of AvO and pH changes, the CIE-WI values decreased in each case as storage time increased because of the hydrolysis of the bleach activator under the storage condition. As shown in FIG. 7, the CIE-WI value from the solution of 3*b*, which has the greatest rate constant of hydrolysis, decreased fastest, while that of 3*e*, which has the smallest rate constant, decreased slowest. This result is consistent with those observed for the HPLC analysis and the change of AvO and pH. More particularly, FIG. 7 exhibits a similar pattern to FIG. 1, which suggests that there is a good correlation between AvO and CIE-WI. Thus, AvO measurement is useful to predict the bleaching activity of the bleach activator.

In sum, the presently disclosed cationic bleach activators as solid forms have good bleaching powers. Such bleaching powers are demonstrated by the fact that the whiteness (CIE-WI) values of cotton fabric bleached with the bleach activators were higher than that of a control fabric. The presently disclosed cationic bleach activators, however, were hydrolyzed in an aqueous solution during storage. Accordingly, the AvO of the bleach activator solutions and the CIE-WI values of cotton fabric bleached with a solution of the presently disclosed cationic bleach activators decreased with an increase in storage time. From the HPLC analysis, the hydrolysis of the presently disclosed cationic bleach activators under storage condition followed a pseudo first order kinetics. The bleach activator having a 6-membered ring as a leaving group had greatest rate constant of hydrolysis and was hydrolyzed faster than TBCC which contains 7-membered ring. The rate of hydrolysis of the bleach activators containing 5-, 8-, and 9-membered ring was slower than that of TBCC suggesting that they are more stable than TBCC in aqueous solution.

III. Representative Bleaching Compositions and Detergent Compositions

As provided hereinbelow, bleaching compositions and detergent compositions can be formulated to comprise the presently disclosed novel cationic bleach activator of Formula (I).

III.A. Bleaching Compositions

In some embodiments, the presently disclosed cationic bleach activators are used in combination with a source of hydrogen peroxide as provided hereinbelow. The levels of the presently disclosed cationic bleach activators can vary, e.g., from about 0.05% to about 95%, by weight, of composition. In some embodiments, lower levels, e.g., from about 0.1% to about 20% can be used.

Thus, in some embodiments, the presently disclosed bleaching composition comprises:

(a) an effective amount of a composition comprising a source of hydrogen peroxide; and (b) an effective amount of a cationic bleach activator of Formula (I):

(I)

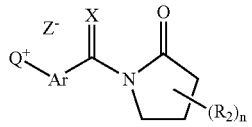

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent.

In some embodiments of the presently disclosed bleaching composition, the cationic bleach activator of Formula (I) has the following chemical structure:

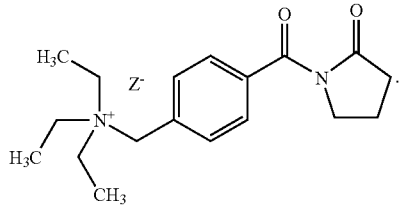

In some embodiments, the bleaching composition comprises:

(a) from about 0.1% to about 50% by weight of the composition comprising a source of hydrogen peroxide; and (b) from about 0.1% to about 50% by weight of the cationic bleach activator of the formula (I).

Further, in some embodiments, as described hereinbelow, the bleaching composition comprises an additive selected from the group consisting of a conventional bleach activator, a transition metal containing bleach catalyst, an optical brightener, a bleach-stable thickener, a detergent builder, a detersive enzyme, a detersive surfactant, a nonionic surfactant, a low-foaming automatic dishwashing surfactant, a laundry detergent surfactant, an anionic surfactant, and combinations thereof, provided that the cationic bleach activator does not react with the anionic surfactant to form a visible precipitate at ambient temperature.

In some embodiments, the conventional bleach activator is selected from the group consisting of an alkanoyloxybenzenesulfonate, tetraacetylethylenediamine, and combinations thereof. In some embodiments, the nonionic surfactant comprises an ethoxylated nonionic surfactant.

In some embodiments, the bleaching composition comprises:

(a) from about 0.1% to about 10% of the cationic bleach activator of Formula (I);
(b) from about 0.5% to about 25% of the source of hydrogen peroxide, wherein the hydrogen peroxide source is in the form of a perborate salt or a percarbonate salt; and
(c) from about 0.1% to about 7% of the low-foaming automatic dishwashing surfactant; and wherein the bleaching composition is in a granular automatic dishwashing detergent form.

In some embodiments, the laundry detergent surfactant is selected from the group consisting of a sugar-derived surfactant, a sarcosinate, an amine oxide, and combinations thereof.

In some embodiments, the bleaching composition comprises:

(a) from about 0.1% to about 10% of the cationic bleach activator;
(b) from about 0.5% to about 25% of the hydrogen peroxide source, wherein the hydrogen peroxide source is in the form of a perborate salt or a percarbonate salt; and
(c) from about 0.5% to about 25% of the laundry detergent surfactant; and wherein the bleaching composition is in a granular laundry detergent form.

In some embodiments, the detergent builder is selected from the group consisting of a citrate, a layered silicate, zeolite A, zeolite P, and combinations thereof.

III.B. Detergent Compositions

The presently disclosed detergent compositions comprise an effective amount and/or a stain removal-improving amount of a presently disclosed bleach activator or the corresponding multiperacid, for example as formed by aqueous alkaline perhydrolysis of the bleach activator in the presence of hydrogen peroxide.

As used herein, an "effective amount" or "stain removal-improving amount" of a presently disclosed bleach activator or its corresponding multiperacid is any amount capable of measurably improving stain removal from soiled fabrics or surfaces when washed by the consumer. In general, this amount can vary depending on the particular application. Representative levels of the presently disclosed cationic bleach activators in such compositions are provided herein.

As provided hereinabove, the presently disclosed cationic bleach activators included in such compositions comprise an aryl or substituted aryl moiety, a quaternary nitrogen group, an appropriate leaving group, and in applications in which the charge is to be balanced, an appropriate counter-anion.

In general, the presently disclosed detergent compositions can be used at a level of from about 800 to about 8,000 ppm in water. In some embodiments, the presently disclosed compositions comprise a source of hydrogen peroxide and a presently disclosed cationic bleach activator. The source of hydrogen peroxide in the detergent compositions can be any common hydrogen-peroxide releasing salt, including, but not limited to, sodium perborate or sodium percarbonate. In some embodiments, additional ingredients including, but not limited to, detersive surfactants for enhanced greasy and particulate soil removal, dispersant polymers to modify and inhibit crystal growth of calcium and/or magnesium salts, chelants to control transition metals, builders to control calcium and/or magnesium and assist buffering action, alkalis to adjust pH, detersive enzymes to assist with tough cleaning, especially of starchy and proteinaceous soils, and soil release polymers, can be present in the presently disclosed detergent compositions. Additional bleach-modifying materials including, but not limited to, bleach catalysts or conventional bleach activators, such as NOBS, TAED, and/or other conventional bleach activators can be added, provided that any such bleach-modifying materials are delivered in such a manner as to be compatible with the purposes of the presently disclosed subject matter.

In some embodiments, the presently disclosed detergent compositions comprise one or more fabric conditioners, processing aids, fillers, fragrances or perfumes, conventional enzyme particle-making materials including enzyme cores or "nonpareils," pigments or blueing agents, fluorescent whitening agents, anti-redeposition aids, such as carboxymethylcellulose, and the like. In general, materials used for the production of the presently disclosed detergent compositions are evaluated for compatibility with the intended end-result. For example, hard surface cleaners, although they can include thickeners and other adjuncts, will typically avoid inclusion of ingredients that can leave unsightly deposits on the surfaces being cleaned. Test methods for cleaning and deposition are generally described in the detergent literature, including DIN test methods.

Amounts of the ingredients in the presently disclosed detergent compositions can vary depending on the particular application. Thus, the presently disclosed detergent compositions, which in some embodiments can have a 1% aqueous solution pH of from about 7 to about 12, and in some embodiments, a pH from about 8 to about 10.5, can have the following ranges of ingredients:

(a) from about 0.1% to about 70%, and in some embodiments, from about 0.5% to about 30% of a source of hydrogen peroxide;
(b) from about 0.1% to about 30%, and in some embodiments, from about 0.1% to about 10% of the presently disclosed bleach activator; wherein the bleach activator is optionally complemented by a conventional bleach activator, such as NOBS at a typical level of from 0% to about 5%;
(c) from about 0.1% to about 70%, and in some embodiments, from about 1% to about 20% of a detersive surfactant; and
(d) from about 0.1% to about 70%, and in some embodiments, from about 1% to about 40% of a builder.

Further, in some embodiments, the presently disclosed compositions comprise from about 0.1% to about 15% of a polymeric dispersant, from about 0.01% to about 10% of a chelant, and from about 0.00001% to about 10% of a detersive enzyme, though further additional or adjunct ingredients, including, but not limited to, soil release polymers, can be present.

Accordingly, in some embodiments, the presently disclosed subject matter provides a detergent composition comprising an effective amount of a cationic bleach activator of Formula (I):

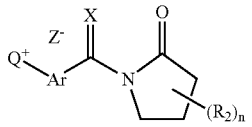

(I)

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent.

In some embodiments, the cationic bleach activator of Formula (I) has the following chemical structure:

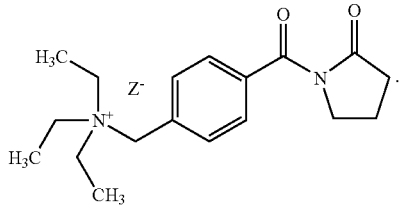

In some embodiments, the presently disclosed detergent composition comprises an additive selected from the group consisting of a conventional bleach activator, a detergent builder, a detersive enzyme, a detersive surfactant, a nonionic surfactant, a low-foaming automatic dishwashing surfactant, a laundry detergent surfactant, an anionic surfactant, a fragrance, and combinations thereof, provided that the cationic bleach activator does not react with the anionic surfactant to form a visible precipitate at ambient temperature.

In some embodiments, the conventional bleach activator is selected from the group consisting of tetraacetylethylenediamine, nonanoyloxybenzenesulfonate, and combinations thereof.

In some embodiments, the detergent composition is substantially free from a phosphate builder and a chlorine bleach.

In some embodiments, the detergent composition is a laundry detergent composition. In some embodiments, the detergent composition is a hard surface cleaning detergent composition.

III.C. Source of Hydrogen Peroxide

A source of hydrogen peroxide as disclosed herein can include any convenient compound or mixture which under typical use conditions provides an effective amount of hydrogen peroxide. Levels of the source of hydrogen peroxide in the bleaching composition can vary widely and are in some embodiments from about 0.5% to about 60%, and in some embodiments, from about 0.5% to about 25% by weight of the bleaching composition.

The source of hydrogen peroxide can be any hydrogen peroxide source known in the art, including, but not limited to, hydrogen peroxide itself. For example, the source of hydrogen peroxide can be a perborate, e.g., sodium perborate (any hydrate, including the mono- or tetra-hydrate), sodium carbonate peroxyhydrate or equivalent percarbonate salts, sodium pyrophosphate peroxyhydrate, urea peroxyhydrate, or sodium peroxide. Mixtures of any convenient hydrogen peroxide sources also can be used.

In some embodiments, the percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources including, but not limited to, FMC (Philadelphia, Pa., United States of America), Solvay (Houston, Tex., United States of America) and Tokai Denka (Japan).

III.D. Adjunct Ingredients

While effective bleaching compositions as described herein can comprise only the presently disclosed cationic bleach activators and a source of hydrogen peroxide, fully-formulated detergent compositions, such as laundry and automatic dishwashing compositions, typically also will comprise other adjunct ingredients to improve or modify performance. Typical, non-limiting examples of such ingredients are disclosed hereinbelow.

III.D.1 Bleach Catalysts

In some embodiments, the presently disclosed bleaches can be catalyzed by means of a transition metal catalyst, such as a manganese compound. Such compounds are known in the art and include, for example, the manganese-based catalysts disclosed in U.S. Pat. No. 5,246,621; U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1.

Representative manganese-based catalysts suitable for use with the presently disclosed subject matter include, but are not limited to, $Mn^{IV}_2(u\text{-}O)_3$(1,4,7-trimethyl-1,4,7-triazacyclononane)$_2(PF_6)_2$; $Mn^{III}_2(u\text{-}O)_1(u\text{-}O)_2$(1,4,7-trimethyl-1,4,7-triazacyclononane)$_2$-$(ClO_4)_2$; $Mn^{IV}_4(u\text{-}O)_6$(1,4,7-triazacyclononane)$_4(ClO_4)_4$; $Mn^{III}$–$Mn^{IV}_4$-$(u\text{-}O)_1(u\text{-}OAc)_2$-(1,4,7-trimethyl-1,4,7-triazacyclo-nonane)$_2$-$(ClO_4)_3$; $Mn^{IV}$-(1,4,7-trimethyl-1,4,7-triazacyclo-nonane)-$(OCH_3)_3(PF_6)$, and combinations thereof. Other metal-based bleach catalysts include those disclosed in U.S. Pat. No. 4,430,243 and U.S. Pat. No. 5,114,611. The use of manganese with various complex ligands to enhance bleaching also is disclosed in the following U.S. Pat. Nos. 4,728,455; 5,284,944; 5,246,612; 5,256,779; 5,280,117; 5,274,147; 5,153,161; and 5,227,084.

The manganese metal ion can be precomplexed with ethylenediaminedisuccinate or separately added, for example as a sulfate salt, with ethylenediaminedisuccinate. Other suitable transition metals in the transition-metal-containing bleach catalysts include iron or copper. Still further suitable transition metals include cobalt (see in particular U.S. Pat. No. 4,810,410 to Diakun et al.); ruthenium, rhodium, and iridium.

By way of example, and not by way of limitation, the bleaching compositions and processes disclosed herein can be adjusted in some embodiments to provide on the order of at least one part per ten million of the active bleach catalyst species in the aqueous washing liquor, and in some embodiments provide from about 0.1 ppm to about 700 ppm, in some embodiments, from about 1 ppm to about 50 ppm, of the catalyst species in the laundry liquor.

III.D.2. Conventional Bleach Activators

The term "conventional bleach activators" as used herein includes any bleach activators that do not exhibit the above-identified characteristics provided in connection with the presently disclosed cationic bleach activators. Many conventional bleach activators are known in the art and can be optionally included in the presently disclosed bleaching compositions. Nonlimiting examples of such conventional bleach activators are disclosed in U.S. Pat. No. 4,915,854 and U.S. Pat. No. 4,412,934.

Typical conventional bleach activators include nonanoyloxybenzene sulfonate (NOBS) and tetraacetyl ethylenediamine (TAED), and combinations thereof. See also U.S. Pat. No. 4,634,551 for other typical conventional bleach activators. Further, amido-derived bleach activators known in the art include those of the formulae: $R_1N(R_5)C(O)R_2C(O)L$ or $R_1C(O)N(R_5)R_2C(O)L$ wherein $R_1$ is an alkyl group containing from about 6 to about 12 carbon atoms, $R_2$ is an alkylene containing from 1 to about 6 carbon atoms, $R_5$ is H or alkyl, aryl, or alkaryl containing from about 1 to about 10 carbon atoms, and L is any suitable leaving group. Further illustrations of optional, conventional bleach activators of the above formulae include (6-octanamido-caproyl)oxybenzenesulfonate, (6-nonanamidocaproyl)oxybenzenesulfonate, (6-decanamidocaproyl)oxybenzenesulfonate, and combinations thereof as described in U.S. Pat. No. 4,634,551.

Another class of conventional bleach activators includes the benzoxazin-type activators disclosed in U.S. Pat. No. 4,966,723. Still another class of conventional bleach activators includes those acyl lactam activators which do not contain any cationic moiety, such as acyl caprolactams and acyl valerolactams of the formulae $R_6C(O)L_1$ and $R_6C(O)L_2$ wherein $R_6$ is selected from the group consisting of H, alkyl, aryl, alkoxyaryl, or alkaryl group containing from 1 to about 12 carbon atoms, or a substituted phenyl group containing from about 6 to about 18 carbons and wherein $L_1$ and $L_2$ are caprolactam or valerolactam moieties. See U.S. Pat. No. 5,348,136, which discloses substituted benzoyl lactams. In some embodiments, the lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam, and combinations thereof. See also U.S. Pat. No. 4,545,784, which discloses acyl caprolactams, including benzoyl caprolactam, adsorbed into sodium perborate.

III.D.3. Bleaching Agents

Bleaching agents other than hydrogen peroxide sources also are known in the art and can be utilized herein as adjunct ingredients. One type of non-oxygen bleaching agent suitable for use with the presently disclosed subject matter includes photoactivated bleaching agents, such as the sulfonated zinc and/or aluminum phthalocyanines. See U.S. Pat. No. 4,033,718. If used, detergent compositions will typically comprise from about 0.025% to about 1.25%, by weight, of such bleaches, for example, sulfonated zinc phthalocyanine.

III.D.4. Organic Peroxides

Organic peroxides, such as diacyl peroxides, are described in Kirk Othmer, *Encyclopedia of Chemical Technology*, Vol. 17, John Wiley and Sons, 1982 at pages 27–90 and especially at pages 63–72, all incorporated herein by reference. Suitable organic peroxides, such as diacyl peroxides, are further illustrated in "Initiators for Polymer Production", Akzo Chemicals Inc. (Dobbs Ferry, N.Y., United States of America), Product Catalog, Bulletin No. 88–57, also incorporated herein by reference. In some embodiments, suitable diacyl peroxides for use herein, whether in pure or formulated form for granule, powder or tablet forms of the bleaching compositions, constitute solids at 25° C., e.g., CADET® BPO 78 powder form of dibenzoyl peroxide, from Akzo. In some embodiments, organic peroxides, for example the diacyl peroxides, for such bleaching compositions have melting points above 40° C., in some embodiments, above 50° C. Additionally, organic peroxides with self accelerating decomposition temperatures (SADT's) (as defined in the foregoing Akzo publication) of 35° C. or higher, in some embodiments, 70° C. or higher are suitable for use in the presently disclosed subject matter. Nonlimiting examples of diacyl peroxides useful herein include dibenzoyl peroxide, lauroyl peroxide, and dicumyl peroxide. In some embodiments, diacyl peroxides are available which contain oily substances, such as dioctyl phthalate. In general, particularly for automatic dishwashing applications, it is preferred to use diacyl peroxides which are substantially free from oily phthalates because such phthalates can form smears on dishes and glassware.

III.D.5. Conventional Quaternary Substituted Bleach Activators

The presently disclosed compositions can optionally comprise known conventional quaternary substituted bleach activators (CQSBA). CQSBA's are further illustrated in U.S. Pat. No. 4,539,130 and U.S. Pat. No. 4,283,301. Additionally, British Pat. 1,382,594, discloses a class of CQSBA's optionally suitable for use herein. U.S. Pat. No. 4,818,426 discloses another class of CQSBA's. Also see U.S. Pat. No. 5,093,022 and U.S. Pat. No. 4,904,406. Additionally, CQSBA's are described in EP 552,812 A1 and in EP 540,090 A2. In some embodiments, the CQSBA's have a caprolactam or valerolactam leaving group.

III.D.6 Detersive Surfactants

Nonlimiting examples of surfactants useful herein include the conventional $C_{11}$–$C_{18}$ alkylbenzene sulfonates ("LAS") and primary, branched-chain and random $C_{10}$–$C_{20}$ alkyl sulfates ("AS"), the $C_{10}$–$C_{18}$ secondary alkyl sulfates of the formula $CH_3(CH_2)_x(CHOSO_3\text{-}M^+)CH_3$ and $CH_3(CH_2)_y(CHOSO_3\text{-}M^+)CH_2CH_3$ where x and y are integers of at least about 7, preferably at least about 9, and M is a water-solubilizing cation, especially sodium, unsaturated sulfates, such as oleyl sulfate, the $C_{10}$–$C_{18}$ alkyl alkoxy sulfates ("AEx S"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. In some embodiments, the conventional nonionic and amphoteric surfactants, such as the $C_{12}$–$C_{18}$ alkyl ethoxylates ("AE") including the so-called narrow peaked alkyl ethoxylates and $C_6$–$C_{12}$ alkyl phenol alkoxylates (such as ethoxylates and mixed ethoxylate/propoxylates), $C_{12}$–$C_{18}$ betaines and sulfobetaines ("sultaines"), $C_{10}$–$C_{18}$ amine oxides, and the like, also can be included in the overall compositions. The $C_{10}$–$C_{18}$ N-alkyl polyhydroxy fatty acid amides also can be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps also can be used. If high sudsing is desired, the branched-chain $C_{10}$–$C_{16}$ soaps can be used. Mixtures of anionic and nonionic surfactants are especially useful. Automatic dishwashing compositions typically employ low sudsing surfactants, such as the mixed ethyleneoxy/propyleneoxy nonionics. Other conventional useful surfactants are listed in standard texts.

III.D.7 Builders

Detergent builders can optionally be included in the compositions herein to assist in controlling mineral hardness. Inorganic as well as organic builders can be used. Builders are typically used in automatic dishwashing and fabric laundering compositions to assist in the removal of particulate soils.

The level of builder can vary depending upon the end use of the composition and its desired physical form. In embodiments wherein a builder is present, the compositions will typically comprise at least about 1% builder. High performance compositions typically comprise from about 10% to about 80%, more typically from about 15% to about 50% by weight, of the detergent builder. Lower or higher levels of builder, however, are not excluded.

Inorganic or P-containing detergent builders include, but are not limited to, the alkaryl metal, ammonium and alkanolammonium salts of polyphosphates (exemplified by the tripolyphosphates, pyrophosphates, and glassy polymeric metephosphates), phosphonates, phytic acid, silicates, carbonates (including bicarbonates and sesquicarbonates), sulphates, and aluminosilicates. Non-phosphate builders, however, are required in some locales. Importantly, the compositions herein can function even in the presence of the so-called "weak" builders (as compared with phosphates) such as citrate, or in the so-called "underbuilt" situation that can occur with zeolite or layered silicate builders. See U.S. Pat. No. 4,605,509 for examples of preferred aluminosilicates.

Examples of silicate builders are the alkaryl metal silicates, particularly those having a $SiO_2$:$Na_2O$ ratio in the range 1.6:1 to 3.2:1 and layered silicates, such as the layered sodium silicates as described in U.S. Pat. No. 4,664,839. NaSKS-6® is a crystalline layered silicate marketed by Hoechst (Frankfurt am Main, Federal Republic of Germany) (commonly abbreviated herein as "SKS-6"). Unlike zeolite builders, the NaSKS-6 silicate builder does not contain aluminum. NaSKS-6 is the δ-$Na_2SiO_5$ morphology form of layered silicate and can be prepared by methods, such as those described in German Patents DE-A-3,417,649 and DE-A-3,742,043. SKS-6 is a suitable layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0, can be used herein. Various other layered silicates from Hoechst include NaSKS-5, NaSKS-7 and NaSKS-11, as the α-, β-, and γ-forms. Other silicates also can be useful, such as for example magnesium silicate, which can serve as a crispening agent in granular formulations, as a stabilizing agent for oxygen bleaches, and as a component of suds control systems.

Silicates useful in automatic dishwashing (ADD) applications include granular hydrous 2-ratio silicates such as BRITESIL® H20 from PQ Corp. (Valley Forge, Pa., United States of America), and the commonly sourced BRITESIL® H24 though liquid grades of various silicates can be used when the ADD composition has liquid form. Within safe limits, sodium metasilicate or sodium hydroxide alone or in combination with other silicates can be used in an ADD context to boost wash pH to a desired level.

Examples of carbonate builders are the alkaline earth and alkaryl metal carbonates as disclosed in German Patent Application No. 2,321,001 published on Nov. 15, 1973. Various grades and types of sodium carbonate and sodium sesquicarbonate can be used, certain of which are particularly useful as carriers for other ingredients, such as detersive surfactants.

Aluminosilicate builders are useful in the present invention. Aluminosilicate builders are of great importance in most currently marketed heavy duty granular detergent compositions, and also can be a significant builder ingredient in liquid detergent formulations. Aluminosilicate builders include those having the empirical formula: $[M_z(zAlO_2)_y].xH_2O$ wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669. Preferred synthetic crystalline aluminosilicate ion exchange materials useful herein are available under the designations Zeolite & Zeolite P (B), Zeolite MAP and Zeolite X. In some embodiments, the crystalline aluminosilicate ion exchange material has the formula: $Na_{12}[(AlO_2)_{12}(SiO_2)_{12}].xH_2O$, wherein x is from about 20 to about 30, especially about 27. This material is known as Zeolite A. Dehydrated zeolites (x=0–10) also can be used herein. Preferably, the aluminosilicate has a particle size of about 0.1–10 microns in diameter. As with other builders, such as carbonates, it can be desirable to use zeolites in any physical or morphological form adapted to promote surfactant carrier function, and appropriate particle sizes can be freely selected by the formulator.

Organic detergent builders suitable for the purposes of the presently disclosed subject matter include, but are not limited to, a wide variety of polycarboxylate compounds. As used herein, the term "polycarboxylate" refers to compounds having a plurality of carboxylate groups, for example at least 3 carboxylates. Polycarboxylate builder can generally be added to the composition in acid form, but also can be added in the form of a neutralized salt or "overbased." When utilized in salt form, alkali metals, such as sodium, potassium, and lithium, or alkanolammonium salts are suitable for the presently disclosed subject matter.

Included among the polycarboxylate builders are a variety of categories of useful materials. One such category of polycarboxylate builders encompasses the ether polycarboxylates, including oxydisuccinate, as disclosed in U.S. Pat. No. 3,128,287; U.S. Pat. No. 3,635,830. See also "TMS/TDS" builders of U.S. Pat. No. 4,663,071. Suitable ether polycarboxylates also include cyclic compounds, particularly alicyclic compounds, such as those described in U.S. Pat. Nos. 3,923,679; 3,835,163; 4,158,635; 4,120,874; and 4,102,903.

Other useful detergency builders include the ether hydroxypolycarboxylates, copolymers of maleic anhydride with ethylene or vinyl methyl ether, 1,3,5-trihydroxybenzene-2,4,6-trisulphonic acid, and carboxymethyloxysuccinic acid, the various alkali metal, ammonium and substituted ammonium salts of polyacetic acids, such as ethylenediaminetetraacetic acid and nitrilotriacetic acid, as well as polycarboxylates, such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty laundry detergent formulations due to their availability from renewable resources and their biodegradability. Citrates also can be used in combination with zeolite and/or layered silicate builders. Oxydisuccinates also are especially useful in such compositions and combinations.

Also suitable in the detergent compositions of the presently disclosed subject matter are the 3,3-dicarboxy-4-oxa-1,6-hexanedioates and the related compounds disclosed in U.S. Pat. No. 4,566,984. Useful succinic acid builders include the $C_5$–$C_{20}$ alkyl and alkenyl succinic acids and salts thereof. In some embodiments, the compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Suitable laurylsuccinates are described in European Patent Application 86200690.5/0, 200,263, published Nov. 5, 1986. Other suitable polycarboxylates are disclosed in U.S. Pat. No. 4,144,226, and in U.S. Pat. No. 3,308,067. See also U.S. Pat. No. 3,723,322.

Fatty acids, e.g., $C_{12}$–$C_{18}$ monocarboxylic acids, also can be incorporated into the compositions alone, or in combination with the aforementioned builders, especially citrate and/or the succinate builders, to provide additional builder activity. Such use of fatty acids will generally result in a diminution of sudsing, which should be taken into account by the formulator.

In embodiments wherein phosphorus-based builders can be used, and especially in the formulation of bars used for hand-laundering operations, the various alkali metal phosphates, such as the well-known sodium tripolyphosphates, sodium pyrophosphate and sodium orthophosphate can be used. Phosphonate builders, such as ethane-1-hydroxy-1,1-diphosphonate and other known phosphonates (see, for example, U.S. Pat. Nos. 3,159,581; 3,213,030; 3,422,021; 3,400,148 and 3,422,137) also can be used.

III.D.8 Chelating Agents

The compositions herein also can optionally contain one or more iron and/or manganese chelating agents, such as hydroxyethyldiphosphonate (HEDP). More generally, chelating agents suitable for use herein can be selected from the group consisting of aminocarboxylates, aminophosphonates, polyfunctionally-substituted aromatic chelating agents and combinations thereof. Without wishing to be bound to any one particular theory, it is believed that the benefit of these materials is due in part to their exceptional ability to remove iron and manganese ions from washing solutions by formation of soluble chelates; other benefits include inorganic film or scale prevention. Other suitable chelating agents for use herein are the commercial DEQUEST® series, and chelants from Nalco, Inc. (Naperville, Ill., United States of America).

Aminocarboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriamine-pentaacetates, and ethanoldiglycines, alkali metal, ammonium, and substituted ammonium salts therein and mixtures therein.

Aminophosphonates also are suitable for use as chelating agents in the presently disclosed compositions when at least low levels of total phosphorus are permitted in detergent compositions, and include ethylenediaminetetrakis (methylenephosphonates). In some embodiments, these aminophosphonates do not contain alkyl or alkenyl groups with more than about 6 carbon atoms.

Polyfunctionally-substituted aromatic chelating agents also are useful in the compositions herein. See U.S. Pat. No. 3,812,044. In some embodiments, compounds of this type in acid form are dihydroxydisulfobenzenes, such as 1,2-dihydroxy-3,5-disulfobenzene.

In some embodiments, a biodegradable chelator for use herein is ethylenediamine disuccinate (EDDS), including, but not limited to, the [S,S] isomer as described in U.S. Pat. No. 4,704,233. The trisodium salt as well as other forms, such as magnesium salts, also can be useful.

If utilized, especially in ADD compositions, these chelating agents or transition-metal-selective sequestrants in some embodiments comprise from about 0.001% to about 10%, in some embodiments, from about 0.05% to about 1% by weight of the bleaching compositions disclosed herein.

III.D.9 Detersive Surfactants Enzymes

Enzymes can be included in the compositions disclosed herein for a variety of fabric laundering or other cleaning purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as combinations thereof. Other types of enzymes also can be included. Such enzymes can be of any suitable origin, such as vegetable, animal, bacterial, fungal and yeast origin. The choice of enzyme is governed by several factors, such as pH-activity and/or stability optima, thermostability, stability versus active detergents, builders, and the like. In this respect bacterial or fungal enzymes, such as bacterial amylases and proteases, and fungal cellulases, are suitable for use with the presently disclosed subject matter.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, and in some embodiments, 0.01%–1% by weight of a commercial enzyme preparation. Protease enzymes are typically present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniformis*. Another suitable protease is obtained from a strain of *Bacillus*, having maximum activity throughout the pH range of 8–12, developed and sold by Novo Industries A/S as ESPERASE® (Copenhagen, Denmark). The preparation of this enzyme and analogous enzymes is described in British Patent Specification No. 1,243,784. Proteolytic enzymes suitable for removing protein-based stains that are commercially available include those sold under the tradenames ALCALASE® and SAVINASE® by Novo Industries A/S and MAXATASE® by International Bio-Synthetics, Inc. (The Netherlands). Other suitable proteases include Protease A (see European Patent Application 130,756, published Jan. 9, 1985) and Protease B (see European Patent Application Serial No. 87303761.8, filed Apr. 28, 1987, and European Patent Application 130,756, published Jan. 9, 1985).

In some embodiments, the enzyme is a protease, referred to as "Protease D" a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76 in combination with one or more amino acid residue positions equivalent to those selected from the group consisting of +99, +101, +103, +107 and +123 in *Bacillus amyloliquefaciens* subtilisin.

Amylases include, for example, α-amylases described in British Patent Specification No. 1,296,839 (Novo), RAPIDASE®, International Bio-Synthetics, Inc. and TERMAMYL®, Novo Industries.

Cellulases usable in the present invention include both bacterial or fungal cellulases. In some embodiments, such cellulases will have a pH optimum of between 5 and 9.5. Suitable cellulases are disclosed in U.S. Pat. No. 4,435,307, which discloses fungal cellulase produced from *Humicola insolens* and *Humicola* strain DSM1800 or a cellulase 212-producing fungus belonging to the genus *Aeromonas*, and cellulase extracted from the hepatopancreas of a marine mollusk (Dolabella Auricula Solander). Suitable cellulases also are disclosed in GB-A-2.075.028; GB-A-2.095.275 and DE-OS-2.247.832. One such cellulase is CAREZYME® (Novo).

Suitable lipase enzymes for detergent use include those produced by microorganisms of the *Pseudomonas* group, such as *Pseudomonas stulzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd. (Nagoya, Japan), under the trade name Lipase P "Amano," hereinafter referred to as "Amano-P." Other commercial lipases include Amano-CES, lipases ex *Chromobacter viscosum*, e.g., *Chromobacter viscosum* var. *lipolyticum* NRRLB 3673, commercially available from Toyo Jozo Co. (Tagata, Japan); and further *Chromobacter viscosum* lipases from U.S. Biochemical Corp. (Cleveland, Ohio, United States of America) and Disoynth Co. (The Netherlands), and lipases ex *Pseudomonas gladioli*. The LIPOLASE® enzyme derived from *Humicola lanuginosa* and commercially available from Novo (see also EPO 341,947) is suitable for use herein.

Peroxidase enzymes can be used in combination with oxygen sources, e.g., percarbonate, perborate, persulfate, hydrogen peroxide, and the like. Such enzymes are used for "solution bleaching," i.e., to prevent the transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, to O. Kirk, assigned to Novo Industries A/S.

A wide range of enzyme materials and means for their incorporation into synthetic detergent compositions also are disclosed in U.S. Pat. No. 3,553,139. Enzymes are further disclosed in U.S. Pat. No. 4,101,457 and in U.S. Pat. No. 4,507,219. Enzyme materials useful for liquid detergent formulations, and their incorporation into such formulations, are disclosed in U.S. Pat. No. 4,261,868. Enzymes for use in detergents can be stabilized by various techniques. Enzyme stabilization techniques are disclosed and exemplified in U.S. Pat. No. 3,600,319 and European Patent Application Publication No. 0 199 405, Application No. 86200586.5, published Oct. 29, 1986, Venegas. Enzyme stabilization systems also are described, for example, in U.S. Pat. No. 3,519,570.

III.D.10. Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This characteristic can enable stains occurring subsequent to treatment with the soil release agent to be more easily cleaned in later washing procedures.

The polymeric soil release agents useful herein include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate: $C_3$ oxyalkylene terephthalate units is about 2:1 or lower, (ii) $C_4$–$C_6$ alkylene or oxy $C_4$–$C_6$ alkylene segments, or mixtures therein, (iii) poly(vinyl ester) segments, preferably polyvinyl acetate, having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of polymeric soil release agent (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580.

Polymeric soil release agents or anti-redeposition agents useful in the present invention also include cellulosic derivatives, such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL® (Dow, Midland, Mich., United States of America). Cellulosic soil release agents for use herein also include those selected from the group consisting of $C_1$–$C_4$ alkyl and $C_4$ hydroxyalkyl cellulose; see U.S. Pat. No. 4,000,093.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN® type of material, e.g., SOKALAN HP-22, available from BASF (Mount Olive, N.J., United States of America).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 and U.S. Pat. No. 3,893,929.

Another suitable polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON® 5126 (from Dupont, Wilmington, Del., United States of America) and MILEASE T® (from ICI, Bridgewater, N.J., United States of America). See also U.S. Pat. No. 4,702,857.

Another suitable polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451. Other suitable polymeric soil release agents include the terephthalate polyesters of U.S. Pat. No. 4,711,730, the anionic end-capped oligomeric esters of U.S. Pat. No. 4,721,580, and the block polyester oligomeric compounds of U.S. Pat. No. 4,702,857.

Suitable polymeric soil release agents also include the soil release agents of U.S. Pat. No. 4,877,896, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. The soil release agent also comprises from about 0.5% to about 20%, by weight of the oligomer, of a crystalline-reducing stabilizer, preferably selected from the group consisting of xylene sulfonate, cumene sulfonate, toluene sulfonate, and combinations thereof.

If utilized, soil release agents in some embodiments comprise from about 0.01% to about 10.0%, by weight, of the detergent compositions herein, in some embodiments from about 0.1% to about 5%, and in some embodiments from about 0.2% to about 3.0%.

III.D.11. Suds Suppressors

The presently disclosed compositions can optionally contain one or more suds suppressors, which can include one or more of the silicone types, fatty acids or soaps, aluminum tristearate, phosphate esters, low-solubility oils, and the like. In some embodiments, levels are from 0% to about 10%, and in some embodiments, from about 0.001% to about 5%. Typical levels tend to be low, e.g., from about 0.01% to about 3% when a silicone suds suppressor is used. Preferable non-phosphate compositions omit phosphate ester-type suds suppressors entirely. Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al.) and "Surfactant Antifoams" (Blease et al.). See also U.S. Pat. Nos. 3,933,672 and 4,136,045. In some embodiments, the silicone suds suppressors are the compounded types known for use in laundry detergents such as heavy-duty granules, although types hitherto used only in heavy-duty liquid detergents also can be incorporated in the presently disclosed compositions. For example, polydimethylsiloxanes having trimethylsilyl or alternate endblocking units can be used as the silicone. These units can be compounded with silica and/or with surface-active nonsilicon components, as illustrated by a suds suppressor comprising 12% silicone/silica, 18% stearyl alcohol and 70% starch in granular form. Exemplary silicone active compounds are available commercially from Dow Corning Corp., Midland, Mich., United States of America.

If it is desired to use a phosphate ester, suitable compounds are disclosed in U.S. Pat. No. 3,314,891, incorporated herein by reference. In some embodiments, the alkyl phosphate esters contain from 16–20 carbon atoms. In some embodiments, the alkyl phosphate esters are monostearyl acid phosphate or monooleyl acid phosphate, or salts thereof, particularly alkali metal salts, or combinations thereof.

III.D.12. pH and Buffering Variation

In some embodiments, the presently disclosed detergent compositions can be buffered, i.e., they are relatively resistant to pH drop in the presence of acidic soils. In some embodiments, the presently disclosed detergent compositions can have exceptionally low buffering capacity, or can be substantially unbuffered. Techniques for controlling or varying pH at recommended usage levels more generally include the use of not only buffers, but also additional alkalis, acids, pH-jump systems, dual compartment containers, etc., and are well known to those skilled in the art. Detergent compositions herein in granular form typically limit water content, for example to less than about 7% free water, for best storage stability.

Storage stability of detergent compositions can be further enhanced by limiting the content in the compositions of adventitious redox-active substances such as rust and other traces of transition metals in undesirable form. Certain compositions can moreover be limited in their total halide ion content, or can have any particular halide, e.g., bromide, substantially absent. Bleach stabilizers such as stannates can be added for improved stability and formulations can be substantially nonaqueous if desired.

III.D.13. Optical Brighteners

Optical brighteners, also referred to as (fluorescent) whitening agents, absorb the UV portion of the sunlight in the wavelength range of about 350 nm, which is invisible for human eyes, and emit blue fluorescence of about 440 nm (500 nm). The fluorescent radiation, for example of the whitening agents absorbed on the textile fibers during washing, adds to the reflected visible light; so a probable yellow hue of a white fabric, which sometimes occurs after several uses and cleaning, is not only regenerated to white again but also an overall intensified white color is achieved. Stilbene derivatives are particularly suitable for the use as brighteners; but also coumarin- and quinolone-(carbostyril)- and 1,3-diphenylpyrazoline structures, naphthalene dicarboxylic acid and cinnamic acid derivatives, as well as combinations of benzoxazole or benzimidazole structures with conjugated systems can be used. Optical brighteners are used in the range of 0 to 5%-wt., preferably in the range of 0.1 to 0.3%-wt.

III.D.14. Other Ingredients

Typical detersive ingredients can include one or more other detersive adjuncts or other materials for assisting or enhancing cleaning performance, treatment of the substrate to be cleaned, or to modify the aesthetics of the detergent composition. Usual detersive adjuncts of detergent compositions include the ingredients set forth in U.S. Pat. No. 3,936,537. Adjuncts which also can be included in detergent compositions employed in the presently disclosed subject matter, in their conventional art-established levels for use (generally from 0% to about 20% of the detergent ingredients, in some embodiments, from about 0.5% to about 10%), include other active ingredients such as dispersant polymers from BASF Corp. or Rohm & Haas (Philadelphia, Pa., United States of America); color speckles, anti-tarnish and/or anti-corrosion agents, dyes, fillers, optical brighteners, germicides, alkalinity sources, hydrotropes, anti-oxidants, enzyme stabilizing agents, fragrances or perfumes, solubilizing agents, clay soil removal/anti-redeposition agents, carders, processing aids, pigments, solvents for liquid formulations, fabric softeners, static control agents, solid fillers for bar compositions, and the like. Dye transfer inhibiting agents, including polyamine N-oxides, such as polyvinylpyridine N-oxide can be used. Dye-transfer-inhibiting agents are further illustrated by polyvinylpyrrolidone and copolymers of N-vinyl imidazole and N-vinyl pyrrolidone. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants, such as the amine oxides, betaines and sultaines noted above also is advantageous. In some embodiments, soluble magnesium salts such as $MgCl_2$, $MgSO_4$, and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. In some embodiments, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT® D10 (Degussa, Düsseldorf, Federal Republic of Germany)) is admixed with a proteolytic enzyme solution containing 3%–5% of $C_{13}$–$C_{15}$ ethoxylated alcohol (EO 7) nonionic surfactant. Typically, the enzyme/surfactant solution is about 2.5 times the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Liquid or gel compositions can contain some water and other fluids as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) also can be used. The compositions can contain from 5% to 90%, typically 10% to 50% of such carriers.

Certain bleaching compositions disclosed herein among the generally encompassed liquid (easily flowable or gel forms) and solid (powder, granule or tablet) forms, especially bleach additive compositions and hard surface cleaning compositions, can be formulated such that the pH is acidic during storage and alkaline during use in aqueous cleaning operations, i.e., the wash water will have a pH in the range from about 7 to about 11.5. Laundry and automatic dishwashing products are typically at pH 7–12, in some embodiments 9 to 11.5. Automatic dishwashing compositions, other than rinse aids which can be acidic, will typically have an aqueous solution pH greater than 7. Techniques for controlling pH at recommended usage levels include the use of buffers, alkalis, acids, pH-jump systems, dual compartment containers, and the like, and are well known to those skilled in the art. The compositions are useful from about 5° C. to the boil for a variety of cleaning and bleaching operations.

Bleaching compositions in granular form typically limit water content, for example, to less than about 7% free water, for best storage stability. Storage stability of bleach compositions can be further enhanced by limiting the content in the compositions of adventitious redox-active substances, such as rust and other traces of transition metals in undesirable form. Certain bleaching compositions can moreover be limited in their total halide ion content, or can have any particular halide, e.g., bromide, substantially absent. Bleach stabilizers, such as stannates can be added for improved stability and liquid formulations can be substantially nonaqueous if desired.

IV. Method for Bleaching a Cellulosic Fiber

In some embodiments, the presently disclosed subject matter provides a method for bleaching a cellulosic fiber, the method comprising:

(a) providing one of an aqueous solution, a dispersion, and a slurry comprising a bleaching composition comprising:

(i) an effective amount of a composition comprising a source of hydrogen peroxide; and (ii) an effective amount of a cationic bleach activator of the formula (I):

(I)

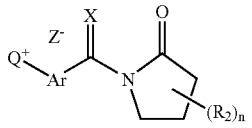

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent; and (b) contacting a cellulosic fiber with the one of an aqueous solution, a dispersion, and a slurry comprising the bleaching solution for a period of time.

In some embodiments, the cationic bleach activator of Formula (I) has the following chemical structure:

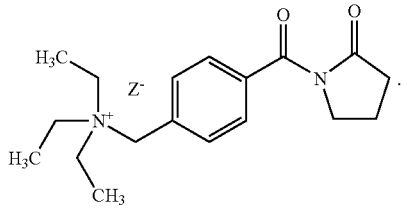

In some embodiments, the cellulosic fiber is selected from the group consisting of a cotton fiber and paper.

V. Method for Bleaching a Chemically Sensitive Material

In some embodiments, the presently disclosed subject matter provides a method for bleaching a chemically sensitive material, the method comprising:

(a) providing one of an aqueous solution, a dispersion, and a slurry comprising a bleaching composition comprising:

(i) an effective amount of a composition comprising a source of hydrogen peroxide; and (ii) an effective amount of a cationic bleach activator of the formula (I):

(I)

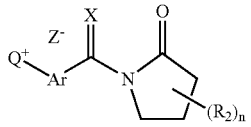

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent; and (b) contacting a chemically sensitive material with the one of an aqueous solution, a dispersion, and a slurry comprising the bleaching solution for a period of time.

In some embodiments, the cationic bleach activator of Formula (I) has the following chemical structure:

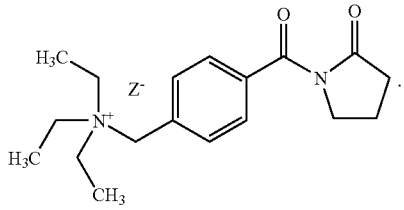

In some embodiments, the chemically sensitive material is selected from the group consisting of wool, a man-made cellulosic fiber, such as TENCEL® (Lenzing Fibers Ltd., Derby, United Kingdom), and a fiber blend.

VI. Method for Removing a Stain or Discoloration from an Article

In some embodiments, the presently disclosed subject matter provides a method for removing a stain or discoloration from an article, the method comprising:

(a) providing one of an aqueous solution, a dispersion, and a slurry comprising a bleaching composition comprising:

(i) an effective amount of a composition comprising a source of hydrogen peroxide; and (ii) an effective amount of a cationic bleach activator of the formula (I):

(I)

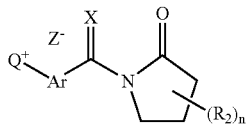

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent; and (b) contacting an article having the stain or discoloration with the one of an aqueous solution, a dispersion, and a slurry comprising the bleaching solution for a period of time.

In some embodiments, the cationic bleach activator of Formula (I) has the following chemical structure:

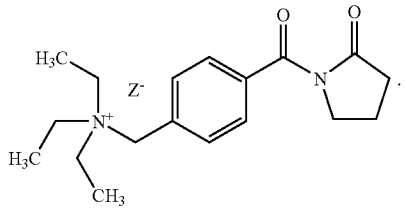

In some embodiments, the article having the stain or discoloration is selected from the group consisting of a fabric, dishware, a hard surface, and combinations thereof.

VII. Method for Oxidizing a Dye in Residual Dyehouse Effluent

In some embodiments, the presently disclosed subject matter provides a method for oxidizing a dye in a residual dyehouse effluent, the method comprising:

(a) providing one of an aqueous solution, a dispersion, and a slurry comprising a bleaching composition comprising:

(i) an effective amount of a composition comprising a source of hydrogen peroxide; and (ii) an effective amount of a cationic bleach activator of the formula (I):

(I)

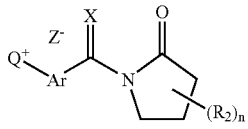

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent; and (b) contacting a residual dyehouse effluent with the one of an aqueous solution, a dispersion, and a slurry comprising the bleaching solution for a period of time to oxidize the dye in the residual dyehouse effluent.

In some embodiments, the cationic bleach activator of Formula (I) has the following chemical structure:

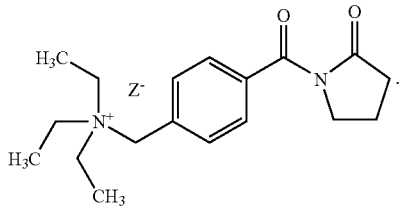

VIII. Definitions

Following long-standing patent law convention, the terms "a", "an", and "the" refer to "one or more" when used in this application, including the claims.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that can vary depending upon the desired properties sought to be obtained by the presently disclosed subject matter. Thus, the term "about," as used herein when referring to a value or to an amount of mass, weight, time, volume, or percentage is meant to encompass variations of ±20% or ±10%, more preferably ±5%, even more preferably ±1%, and still more preferably ±0.1% from the specified amount, as such variations are appropriate to perform the disclosed method.

The terms "quaternary" or "tetravalent" are used interchangeably and refer to nitrogen atoms that participate in either four single bonds, two single bonds and one double bond, one single bond and one triple bond, or two double bonds. Bonds to tetravalent nitrogen can include N—H bonds and other bonds, such as N—O bonds. In some embodiments of the presently disclosed subject matter, each quaternary or tetravalent nitrogen atom is bonded to a carbon atom, for example, a carbon atom of an alkyl group, as depicted in the following structure:

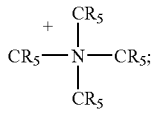

wherein $R_5$ is an alkyl group or substituted alkyl group as defined hereinbelow.

As used herein the term "alkyl" refers to $C_{1-20}$ inclusive, linear (i.e., "straight-chain"), branched, or cyclic, saturated or at least partially and in some cases fully unsaturated (i.e., alkenyl and alkynyl) hydrocarbon chains, including for example, methyl, ethyl, propyl, isopropyl, butyl, isobutyl, tert-butyl, pentyl, hexyl, octyl, ethenyl, propenyl, butenyl, pentenyl, hexenyl, octenyl, butadienyl, propynyl, butynyl, pentynyl, hexynyl, heptynyl, and allenyl groups. "Branched" refers to an alkyl group in which a lower alkyl group, such as methyl, ethyl or propyl, is attached to a linear alkyl chain. "Lower alkyl" refers to an alkyl group having 1 to about 8 carbon atoms (i.e., a $C_{1-8}$ alkyl), e.g., 1, 2, 3, 4, 5, 6, 7, or 8 carbon atoms. "Higher alkyl" refers to an alkyl group having about 10 to about 20 carbon atoms, e.g., 10, 11, 12, 13, 14, 15, 16, 17, 18, 19, or 20 carbon atoms. In certain embodiments, "alkyl" refers, in particular, to $C_{1-8}$ straight-chain alkyls. In other embodiments, "alkyl" refers, in particular, to $C_{1-8}$ branched-chain alkyls.

Alkyl groups can optionally be substituted (a "substituted alkyl") with one or more alkyl group substituents, which can be the same or different. The term "alkyl group substituent" includes but is not limited to alkyl, substituted alkyl, halo, arylamino, acyl, hydroxyl, arylkyl, aryloxyl, alkoxyl, alkylthio, arylthio, aralkyloxyl, aralkylthio, carboxyl, alkoxycarbonyl, oxo, and cycloalkyl. There can be optionally inserted along the alkyl chain one or more oxygen, sulfur or substituted or unsubstituted nitrogen atoms, wherein the nitrogen substituent is hydrogen, lower alkyl (also referred to herein as "alkylaminoalkyl"), or aryl.

Thus, as used herein, the term "substituted alkyl" includes alkyl groups, as defined herein, in which one or more atoms or functional groups of the alkyl group are replaced with another atom or functional group, including for example, alkyl, substituted alkyl, halogen, aryl, substituted aryl, alkoxyl, hydroxyl, nitro, amino, alkylamino, dialkylamino, sulfate, and mercapto.

The term "aryl" is used herein to refer to an aromatic substituent that can be a single aromatic ring, or multiple aromatic rings that are fused together, linked covalently, or linked to a common group, such as, but not limited to, a methylene or ethylene moiety. The common linking group also can be a carbonyl, as in benzophenone, or oxygen, as in diphenylether, or nitrogen, as in diphenylamine. The term "aryl" specifically encompasses heterocyclic aromatic compounds. The aromatic ring(s) can comprise phenyl, naphthyl, biphenyl, diphenylether, diphenylamine and benzophenone, among others. In particular embodiments, the term "aryl" means a cyclic aromatic comprising about 5 to about 10 carbon atoms, e.g., 5, 6, 7, 8, 9, or 10 carbon atoms, and including 5- and 6-membered hydrocarbon and heterocyclic aromatic rings.

The aryl group can be optionally substituted (a "substituted aryl") with one or more aryl group substituents, which can be the same or different, wherein "aryl group substituent" includes alkyl, substituted alkyl, aryl, substituted aryl, aralkyl, hydroxyl, alkoxyl, aryloxyl, aralkyloxyl, carboxyl, acyl, halo, nitro, alkoxycarbonyl, aryloxycarbonyl, aralkoxycarbonyl, acyloxyl, acylamino, aroylamino, carbamoyl, alkylcarbamoyl, dialkylcarbamoyl, arylthio, alkylthio, alkylene, and —NR'R", wherein R' and R" can each be independently hydrogen, alkyl, substituted alkyl, aryl, substituted aryl, and aralkyl.

Thus, as used herein, the term "substituted aryl" includes aryl groups, as defined herein, in which one or more atoms or functional groups of the aryl group are replaced with another atom or functional group, including for example, alkyl, substituted alkyl, halogen, aryl, substituted aryl, alkoxyl, hydroxyl, nitro, amino, alkylamino, dialkylamino, sulfate, and mercapto.

Specific examples of aryl groups include, but are not limited to, cyclopentadienyl, phenyl, furan, thiophene, pyrrole, pyran, pyridine, imidazole, benzimidazole, isothiazole, isoxazole, pyrazole, pyrazine, triazine, pyrimidine, quinoline, isoquinoline, indole, carbazole, and the like.

A structure represented generally by a formula such as:

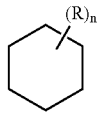

or

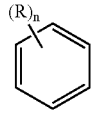

as used herein refers to a ring structure, for example, but not limited to a 3-carbon, a 4-carbon, a 5-carbon, a 6-carbon, and the like, aliphatic and/or aromatic cyclic compound comprising a substituent R group, wherein the R group can be present or absent, and when present, one or more R groups can each be substituted on one or more available carbon atoms of the ring structure. The presence or absence of the R group and number of R groups is determined by the value of the integer n. Each R group, if more than one, is substituted on an available carbon of the ring structure rather than on another R group. For example, the structure:

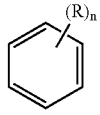

wherein n is an integer from 0 to 2 comprises compound groups including, but not limited to:

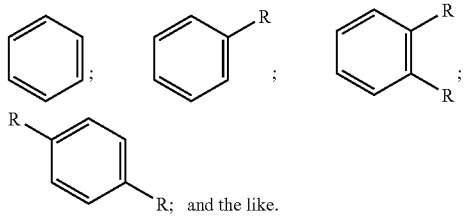

; ; ; R; and the like.

A dashed line representing a bond in a cyclic ring structure indicates that the bond can be either present or absent in the ring. That is a dashed line representing a bond in a cyclic ring structure indicates that the ring structure is selected from the group consisting of a saturated ring structure, a partially saturated ring structure, and an unsaturated ring structure.

In some embodiments, the compounds described by the presently disclosed subject matter contain a linking group. As used herein, the term "linking group" comprises a chemical moiety, such as a furanyl, phenylene, thienyl, and pyrrolyl radical, which is bonded to two or more other chemical moieties, in particular aryl groups, to form a stable structure.

When a named atom of an aromatic ring or a heterocyclic aromatic ring is defined as being "absent," the named atom is replaced by a direct bond. When the linking group or spacer group is defined as being absent, the linking group or spacer group is replaced by a direct bond.

"Alkylene" refers to a straight or branched bivalent aliphatic hydrocarbon group having from 1 to about 20 carbon atoms, e.g., 1, 2, 3, 4, 5, 6, 7, 8, 9, 10, 11, 12, 13, 14, 15, 16, 17, 18, 19, or 20 carbon atoms. The alkylene group can be straight, branched or cyclic. The alkylene group also can be optionally unsaturated and/or substituted with one or more "alkyl group substituents." There can be optionally inserted along the alkylene group one or more oxygen, sulfur or substituted or unsubstituted nitrogen atoms (also referred to herein as "alkylaminoalkyl"), wherein the nitrogen substituent is alkyl as previously described. Exemplary alkylene groups include methylene (—$CH_2$—); ethylene (—$CH_2$—$CH_2$—); propylene (—$(CH_2)_3$—); cyclohexylene (—$C_6H_{10}$—); —CH═CH—CH═CH—; —CH═CH—$CH_2$—; —$(CH_2)_q$—N(R)—$(CH_2)_r$—, wherein each of q and r is independently an integer from 0 to about 20, e.g., 0, 1, 2, 3, 4, 5, 6, 7, 8, 9, 10, 11, 12, 13, 14, 15, 16, 17, 18, 19, or 20, and R is hydrogen or lower alkyl; methylenedioxyl (—O—$CH_2$—O—); and ethylenedioxyl (—O—$(CH_2)_2$—O—). An alkylene group can have about 2 to about 3 carbon atoms and can further have 6–20 carbons.

As used herein, the term "acyl" refers to an organic carboxylic acid group wherein the —OH of the carboxyl group has been replaced with another substituent (i.e., as represented by RCO—, wherein R is an alkyl or an aryl group as defined herein). As such, the term "acyl" specifically includes arylacyl groups, such as an acetylfuran and a phenacyl group. Specific examples of acyl groups include acetyl and benzoyl.

"Cyclic" and "cycloalkyl" refer to a non-aromatic mono- or multicyclic ring system of about 3 to about 10 carbon atoms, e.g., 3, 4, 5, 6, 7, 8, 9, or 10 carbon atoms. The cycloalkyl group can be optionally partially unsaturated. The cycloalkyl group also can be optionally substituted with an alkyl group substituent as defined herein, oxo, and/or alkylene. There can be optionally inserted along the cyclic alkyl chain one or more oxygen, sulfur or substituted or unsubstituted nitrogen atoms, wherein the nitrogen substituent is hydrogen, alkyl, substituted alkyl, aryl, or substituted aryl, thus providing a heterocyclic group. Representative monocyclic cycloalkyl rings include cyclopentyl, cyclohexyl, and cycloheptyl. Multicyclic cycloalkyl rings include adamantyl, octahydronaphthyl, decalin, camphor, camphane, and noradamantyl.

"Alkoxyl" refers to an alkyl-O— group wherein alkyl is as previously described. The term "alkoxyl" as used herein can refer to, for example, methoxyl, ethoxyl, propoxyl, isopropoxyl, butoxyl, t-butoxyl, and pentoxyl. The term "oxyalkyl" can be used interchangeably with "alkoxyl".

"Aryloxyl" refers to an aryl-O— group wherein the aryl group is as previously described, including a substituted aryl. The term "aryloxyl" as used herein can refer to phenyloxyl or hexyloxyl, and alkyl, substituted alkyl, halo, or alkoxyl substituted phenyloxyl or hexyloxyl.

"Aralkyl" refers to an aryl-alkyl- group or an alkyl-aryl-group wherein aryl and alkyl are as previously described, and included substituted aryl and substituted alkyl. Exemplary aralkyl groups include benzyl, phenylethyl, and naphthylmethyl.

"Aralkyloxyl" refers to an aralkyl-O— group wherein the aralkyl group is as previously described. An exemplary aralkyloxyl group is benzyloxyl.

"Dialkylamino" refers to an —NRR' group wherein each of R and R' is independently an alkyl group and/or a substituted alkyl group as previously described. Exemplary alkylamino groups include ethylmethylamino, dimethylamino, and diethylamino.

"Alkoxycarbonyl" refers to an alkyl-O—CO— group. Exemplary alkoxycarbonyl groups include methoxycarbonyl, ethoxycarbonyl, butyloxycarbonyl, and t-butyloxycarbonyl.

"Aryloxycarbonyl" refers to an aryl-O—CO— group. Exemplary aryloxycarbonyl groups include phenoxy- and naphthoxy-carbonyl.

"Aralkoxycarbonyl" refers to an aralkyl-O—CO— group. An exemplary aralkoxycarbonyl group is benzyloxycarbonyl.

"Carbamoyl" refers to an $H_2N$—CO— group.

"Alkylcarbamoyl" refers to a R'RN—CO— group wherein one of R and R' is hydrogen and the other of R and R' is alkyl and/or substituted alkyl as previously described.

"Dialkylcarbamoyl" refers to a R'RN—CO— group wherein each of R and R' is independently alkyl and/or substituted alkyl as previously described.

"Acyloxyl" refers to an acyl-O— group wherein acyl is as previously described.

"Acylamino" refers to an acyl-NH— group wherein acyl is as previously described.

The term "amino" refers to the —$NH_2$ group.

The term "carbonyl" refers to the —(C═O)— group.

The term "carboxyl" refers to the —COOH group.

The terms "halo", "halide", or "halogen" as used herein refer to fluoro, chloro, bromo, and iodo groups.

The term "hydroxyl" refers to the —OH group.

The term "hydroxyalkyl" refers to an alkyl group substituted with an —OH group.

The term "mercapto" refers to the —SH group.

The term "oxo" refers to a compound described previously herein wherein a carbon atom is replaced by an oxygen atom.

The term "nitro" refers to the —$NO_2$ group.

The term "thio" refers to a compound described previously herein wherein a carbon or oxygen atom is replaced by a sulfur atom.

The term "sulfate" refers to the —$SO_4$ group.

When the term "independently selected" is used, the substituents being referred to (e.g., R groups, such as groups $R_1$ and $R_2$, or groups X and Y), can be identical or different. For example, both $R_1$ and $R_2$ can be substituted alkyls, or $R_1$ can be hydrogen and $R_2$ can be a substituted alkyl, and the like.

A named "R", "X", "A", "B," "D", "E" or "Q" group will generally have the structure that is recognized in the art as corresponding to a group having that name, unless specified otherwise herein. For the purposes of illustration, certain representative "R," "X," and "A" groups as set forth above are defined below. These definitions are intended to supplement and illustrate, not preclude, the definitions that would be apparent to one of ordinary skill in the art upon review of the present disclosure.

IX. EXAMPLES

The following Examples have been included to illustrate modes of the presently disclosed subject matter. Certain aspects of the following Examples are described in terms of techniques and procedures found or contemplated by the present co-inventors to work well in the practice of the presently disclosed subject matter. These Examples illustrate standard practices of the co-inventors. In light of the present disclosure and the general level of skill in the art, those of skill will appreciate that the following Examples are intended to be exemplary only and that numerous changes, modifications, and alterations can be employed without departing from the scope of the presently disclosed subject matter.

Materials

γ-Butyrolactam (98%), δ-valerolactam (98%), ϵ-caprolactam (99%), ω-heptalactam (99%), and ω-octalactam (98%), which are representative leaving groups of the presently disclosed bleach activators, were purchased from TCI America (Portland, Oreg., United States of America). 4-Chloromethylbenzoyl chloride (98%) was purchased from TCI America and triethylamine (99.5%) was purchased from Sigma-Aldrich Co. (St. Louis, Mo., United States of America) and each was used without further purification. Potassium iodide solution (KI, 10% w/v) and sodium thiosulfate solution ($Na_2S_2O_3$, 0.025N) were purchased from Fisher Scientific Co. (Fairlawn, N.J., United States of America) and used for iodometric titration. Single jersey circular-knitted greige cotton fabric (175 g/m$^2$, 18/1 Ne OE 100%) was provided by Proctor & Gamble Co. (Cincinnati, Ohio, United States of America). A wetting agent (Kieralon JET-B) and a hydrogen peroxide stabilizer (Prestogen N-D) were obtained from BASF Corporation (Charlotte, N.C., United States of America). All other chemicals used were of laboratory grade.

Instrumentation

Melting points were recorded in capillary tubes on a Mel-Temp apparatus (Barnstead/Thermolyne, Dubuque, Iowa, United States of America) and are uncorrected. Nuclear magnetic resonance ($^1$H NMR) spectra were recorded in $CDCl_3$ using a Bruker Avance Spectrometer (Bruker Biospin Corporation, Billerica, Mass., United States of America) at 500 MHz. Mass spectra were recorded in fast atom bombardment ionisation mode using a Jeol HX-110 Magnetic Sector Mass spectrometer (JOEL USA, Inc., Peabody, Mass., United States of America). Elemental analysis was recorded on a Perkin-Elmer 2400 elemental analyzer (PerkinElmer, Inc., Boston, Mass., United States of America).

IX.A. Example 1

Synthesis of Novel Cationic Bleach Activators

Representative novel cationic bleach activators of the presently disclosed subject matter were synthesized according to Scheme 3.

Scheme 3. Synthesis of Representative Cationic Bleach Activators

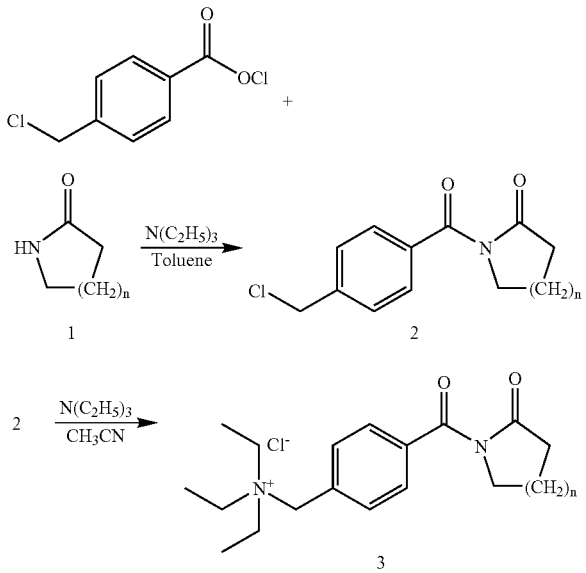

| Compound | | | n |
|---|---|---|---|
| 1a | 2a | 3a | 1 |
| 1b | 2b | 3b | 2 |
| 1c | 2c | 3c | 3 |
| 1d | 2d | 3d | 4 |
| 1e | 2e | 3e | 5 |

Intermediates 2*a*–2*e*. The synthesis of intermediates 2*a*–2*e* was carried out according to described procedures. See U.S. Pat. No. 5,686,015 to Willey et al., the disclosure of which is incorporated herein by reference in its entirety.

Referring now to Scheme 3, intermediates, 2*a*–2*e*, were prepared by condensation reaction of 4-chloromethyl benzoyl acid chloride with lactam leaving groups, 1*a*–1*e*. Each lactam (1*a*–1*e*, 0.2 mol) was mixed with triethylamine (30.5 g, 0.3 mol) and toluene (225 mL) under argon. The solution was heated to reflux. 4-Chloromethyl benzoyl chloride (38.6 g, 0.2 mol) suspended in toluene (75 mL) was added slowly to the solution. The solution was stirred at reflux for 6 hours, cooled to room temperature and filtered. The filterate was refrigerated over night. The precipitated product was filtered, washed with cold toluene and dried. The structures of 2*a*–2*e* were confirmed from NMR analysis.

2*a* (4-chloromethyl benzoyl butyrolactam): Yield 59.7%. $\delta_H(CDCl_3)$/ppm 2.13–2.19 (2H, m, $CH_2C\underline{H}_2CH_2$), 2.61–2.64 (2H, t, $COCH_2$), 3.95–3.98 (2H, t, $NC\underline{H}_2CH_2$), 4.62 (1H, s, $ArCH_2$), 7.43–7.45 (2H, d, ArH), 7.60–7.61 (2H, d, ArH).

2*b* (4-chloromethyl benzoyl valerolactam): Yield 59.8%. $\delta_H(CDCl_3)$/ppm 1.95–1.97 (2H, m, $COCH_2C\underline{H}_2CH_2$), 1.98–2.00 (2H, m, $COCH_2C\underline{H}_2CH_2$), 2.56–2.59 (2H, t, $COCH_2$), 3.80–3.82 (2H, t, $NC\underline{H}_2CH_2$), 4.59 (1H, s, $ArCH_2$), 7.40–7.42 (2H, d, ArH), 7.53–7.54 (2H, d, ArH).

2*c* (4-chloromethyl benzoyl caprolactam): Yield 62.7%. $\delta_H(CDCl_3)$/ppm 1.80–1.92 (6H, m, $COCH_2(C\underline{H}_2)_3$), 2.69–2.71 (2H, t, $COCH_2$), 3.96–3.98 (2H, t, $NC\underline{H}_2CH_2$), 4.60 (1H, s, $ArCH_2$), 7.40–7.42 (2H, d, ArH), 7.55–7.56 (2H, d, ArH).

2*d* (4-chloromethyl benzoyl heptalactam): Yield 82.6%. $\delta_H(CDCl_3)$/ppm 1.55–1.95 (8H, m, $COCH_2(C\underline{H}_2)_4$), 2.66–2.69 (2H, t, $COCH_2$), 3.99–4.01 (2H, t, $NC\underline{H}_2CH_2$), 4.59 (1H, s, $ArCH_2$), 7.40–7.41 (2H, d, ArH), 7.50–7.52 (2H, d, ArH).

2e (4-chloromethyl benzoyl octalactam): Yield 89.8%. $\delta_H(CDCl_3)$/ppm 1.50–1.93 (10H, m, $COCH_2(C\underline{H}_2)_5$), 2.45–2.48 (2H, t, $COCH_2$), 3.96–3.98 (2H, t, $NC\underline{H}_2CH_2$), 4.61 (1H, s, $ArCH_2$), 7.42–7.44 (2H, d, ArH), 7.59–7.61 (2H, d, ArH).

Cationic bleach activators 3a–3e. The synthesis of intermediates 3a–3e was carried out according to described procedures. See U.S. Pat. No. 5,686,015 to Willey et al.

Referring once again to Scheme 3, the intermediates 2a–2e were quaternized with triethylamine to give the cationic bleach activators, 3a–3e. More particularly, 4-chloromethyl benzoyl lactams (2a–2e, 0.2 mol) were dissolved in 300 mL of acetonitrile under argon. Triethylamine (0.4 mol) was added dropwise to the solution and the solution was stirred at reflux for 4 hours. The solution was cooled to room temperature and the solvent was evaporated. Acetone (200 mL) was added and the mixture was heated briefly and cooled to room temperature. The product was filtered, washed with acetone and dried. The presently disclosed cationic bleach activators were readily soluble in water with solubilities being over 200 g/L. The structures of 3a–3e were confirmed from the following data.

3a N-[4-(triethylammoniomethyl)benzoyl] butyrolactam chloride: Yield 91.1%. mp 228–230° C.; $\delta_H(CDCl_3)$/ppm 1.44–1.47 (9H, t, $N(CH_2C\underline{H}_3)_3$), 2.16–2.22 (2H, m, $CH_2C\underline{H}_2CH_2$), 2.60–2.64 (2H, t, $COCH_2$), 3.40–3.44 (6H, q, $N(C\underline{H}_2CH_3)_3$), 3.96–3.99 (2H, t, $NC\underline{H}_2CH_2$), 4.92 (1H, s, $ArCH_2$), 7.59–7.61 (2H, d, ArH), 7.66–7.68 (2H, d, ArH); m/z (FAB-MS) 303.3 $[(M-Cl)^+$. Calc. for $C_{18}H_{27}N_2O_2$: 303.2]; microanalysis calc. for $C_{18}H_{27}N_2O_2$: C, 63.80; H, 8.03; N, 8.27%. Found: C, 63.78; H, 8.05; N, 8.24%.

3b N-[4-(triethylammoniomethyl)benzoyl] valerolactam chloride: Yield 88.9%. mp 187–189° C.; $\delta_H(CDCl_3)$/ppm 1.43–1.46 (9H, t, $N(CH_2C\underline{H}_3)_3$), 1.95–1.99 (2H, m, $COCH_2C\underline{H}_2CH_2$), 2.00–2.03 (2H, m, $COCH_2CH_2C\underline{H}_2$), 2.55–2.58 (2H, t, $COCH_2$), 3.40–3.45 (6H, q, $N(C\underline{H}_2CH_3)_3$), 3.81–3.83 (2H, t, $NC\underline{H}_2CH_2$), 4.93 (1H, s, $ArCH_2$), 7.55–7.56 (2H, d, ArH), 7.68–7.69 (2H, d, ArH); m/z (FAB-MS) 317.3 $[(M-Cl)^+$. Calc. for $C_{19}H_{29}N_2O_2$: 317.2]; microanalysis calc. for $C_{19}H_{29}ClN_2O_2.H_2O$: C, 61.52; H, 8.42; N, 7.55%. Found: C, 62.33; H, 8.43; N, 7.49%.

3c N-[4-(triethylammoniomethyl)benzoyl] caprolactam chloride: Yield 95.9%. mp 212–214° C.; $\delta_H(CDCl_3)$/ppm 1.43–1.46 (9H, t, $N(CH_2C\underline{H}_3)_3$), 1.78–1.90 (6H, m, $COCH_2(C\underline{H}_2)_3$), 2.68–2.70 (2H, t, $COCH_2$), 3.43–3.47 (6H, q, $N(C\underline{H}_2CH_3)_3$), 3.97–3.99 (2H, t, $NC\underline{H}_2CH_2$), 4.98 (1H, s, $ArCH_2$), 7.54–7.55 (2H, d, ArH), 7.70–7.72 (2H, d, ArH); m/z (FAB-MS) 331.3 $[(M-Cl)^+$. Calc. for $C_{20}H_{31}N_2O_2$: 331.2]; microanalysis calc. for $C_{20}H_{31}ClN_2O_2$: C, 65.47; H, 8.52; N, 7.63%. Found: C, 65.34; H, 8.56; N, 7.64%.

3d N-[4-(triethylammoniomethyl)benzoyl] heptalactam chloride: Yield 83.2%. mp 194–196° C.; $\delta_H(CDCl_3)$/ppm 1.43–1.45 (9H, t, $N(CH_2C\underline{H}_3)_3$), 1.54–1.92 (8H, m, $COCH_2(C\underline{H}_2)_4$), 2.66–2.68 (2H, t, $COCH_2$), 3.39–3.44 (6H, q, $N(C\underline{H}_2CH_3)_3$), 4.01–4.03 (2H, t, $NC\underline{H}_2CH_2$), 4.91 (1H, s, $ArCH_2$), 7.52–7.54 (2H, d, ArH), 7.67–7.68 (2H, d, ArH); m/z (FAB-MS) 345.3 $[(M-Cl)^+$. Calc. for $C_{21}H_{33}N_2O_2$: 345.3]; microanalysis calc. for $C_{21}H_{33}ClN_2O_2.H_2O$: C, 63.22; H, 8.84; N, 7.02%. Found: C, 63.75; H, 8.91; N, 7.01%.

3e N-[4-(triethylammoniomethyl)benzoyl] octalactam chloride: Yield 74.6%. mp 183–185° C.; $\delta_H(CDCl_3)$/ppm 1.43–1.45 (9H, t, $N(CH_2C\underline{H}_3)_3$), 1.48–1.91 (10H, m, $COCH_2(C\underline{H}_2)_5$), 2.43–2.46 (2H, t, $COCH_2$), 3.41–3.46 (6H, q, $N(C\underline{H}_2CH_3)_3$), 3.97–4.00 (2H, t, $NC\underline{H}_2CH_2$), 5.00 (1H, s, $ArCH_2$), 7.54–7.56 (2H, d, ArH), 7.71–7.73 (2H, d, ArH); m/z (FAB-MS) 359.4 $[(M-Cl)^+$. Calc. for $C_{22}H_{35}N_2O_2$: 359.3]; microanalysis calc. for $C_{22}H_{35}ClN_2O_2$: C, 66.90; H, 8.93; N, 7.09%. Found: C, 66.54; H, 9.03; N, 7.03%.

IX.B. Example 2

Preparation of Storage Solution

Aqueous solutions (10% w/w) of cationic bleach activators 3a–3e were prepared using pH 5 buffer solution. A buffer solution of pH 5 was made using sodium acetate (0.1 M)/acetic acid. Each solution was stored in an amber glass bottle at room temperature.

IX.C. Example 3

AvO Measurement

AvO of a bleach activator was measured using a previously described procedure. See J. J. Lee, S. Lim, P. Hauser and D. Hinks, *Color. Technol.,* 121 (2005) 37, the disclosure of which is incorporated herein by reference in its entirety.

On the selected day, the pH value of each storage solution was recorded and a 2 mL aliquot was withdrawn and added to a mixture of deionized water, stabilizer (1 g/L), $Na_2CO_3$ (14 g/L) and $H_2O_2$ (50% w/w, 0.5 g/L) to make a total volume of 200 mL. Crushed ice (180 g) was added to the sample solution while stirring. Acetic acid (50 mL) and potassium iodide solution (10 mL, 10% w/v) were then added separately. Using 0.025N sodium thiosulfate solution, the sample solution was titrated until it turned colorless. AvO (ppm) of a bleach activator was calculated using Equation 3.

$$\begin{aligned} AvO_{[bleach\ activator]}(\text{ppm}) &= AvO_{[total]} - AvO_{[H_2O_2]} \\ &= \frac{(V_{total} - V_{H_2O_2}) \times \text{normality } Na_2S_2O_3 \times 8}{\text{sample volume in liters}} \\ &= \frac{(V_{total} - V_{H_2O_2}) \times 0.025 \times 8}{200/1000} = V_{total} - V_{H_2O_2} \end{aligned} \quad \text{(eq 3)}$$

wherein, $V_{total}$ and $V_{H2O2}$ are the volume (mL) of $Na_2S_2O_3$ solution required for the titration of sample and blank respectively.

IX.D. Example 4

Bleaching

On the same day of the AvO measurement, bleaching was carried out with storage solutions of the bleach activators 3a–3e. Two grams of each solution was added to the bleaching solution, which comprised a wetting agent (1 g/L), stabilizer (1 g/L), NaOH (50% w/w, 3 g/L) and $H_2O_2$ (50% w/w, 3 g/L). Cotton fabric (10 g) was bleached in a laboratory IR dyeing machine (Ahiba Nuance, Datacolor International, Lawrenceville, N.J., United States of America) at a liquor ratio of 10:1. The temperature was raised to 70° C. at the rate of 4° C./min. After 50 min of bleaching, the bleaching bath was cooled to room temperature. The bleached fabric was rinsed thoroughly in tap water and air-dried.

IX.E. Example 5

Whiteness Measurement

The CIE Whiteness Index (WI) value was obtained for the bleached fabric using AATCC Test Method 110–1995. See *AATCC Technical Manual*, vol 75 (Research Triangle Park: American Association of Textile Chemists and colorists, 2000), the disclosure of which is incorporated herein by reference in its entirety.

The whiteness was measured on a UV calibrated Datacolor Spectraflash SF 600X (Datacolor Corporation, Lawrenceville, N.J., United States of America), under illuminant D65 using the 10° standard observer with specular and UV component included. Each sample was folded twice to give an opaque sample with four plies and whiteness was measured four times at different surfaces. The average value of CIE WI was recorded.

IX.F. Example 6

HPLC Analysis

The HPLC (Waters Breeze HPLC system, Waters Corporation, Milford, Mass., United States of America) with a C18 reverse-phase column (Waters Symmetry C18, 5 μm) was used to analyze the hydrolysis behaviors of the cationic bleach activators 3*a*–3*e* during storage. On the selected day, a 0.5 mL aliquot was withdrawn from each storage solution of 3*a*–3*e* and diluted with 24.5 mL of water. A 10-μL sample of the solution was injected into the HPLC. For the mobile phase, the gradient program using water with 0.005M heptanesulphonic acid as a solvent A and acetonitrile as a solvent B was used (Table 2). The flow rate was 1 mL/min.

TABLE 2

Gradient Program of Mobile Phase for HPLC Analysis

| Time (min) | % A[a] | % B[a] |
|---|---|---|
| 0 | 90 | 10 |
| 10 | 55 | 45 |
| 11 | 10 | 90 |
| 12 | 90 | 10 |

[a]A: water + 0.005 M heptanesulphonic acid; B: Acetonitrile.

X. REFERENCES

The references listed below as well as all references cited in the specification are incorporated herein by reference to the extent that they supplement, explain, provide a background for or teach methodology, techniques and/or compositions employed herein. All cited patents and publications referred to in this application are herein expressly incorporated by reference.

A. P. James and I. S. MacKirdy, *Chem. Ind.,* 15 (1990) 641.

K. Grime and A. Clauss, *Chem. Ind.,* 15 (1990) 647.

R. J. McLean, *Text. Chem. Colorist Am. Dyestuff Rep.,* 1 (1999) 42.

S. J. Scarborough and A. J. Mathews, *Text Chem. Colorist Am. Dyestuff Rep.,* 32 (2000) 33.

J. Y. Cai, D. J. Evans and S. M. Smith, *AATCC Rev.,* 1 (2001) 31.

J. Wang and N. M. Washington, *AATCC Rev.,* 2 (2002) 21.

S. Lim, N. C. Gürsoy, P. Hauser and D. Hinks, *Color. Technol.,* 120 (2004) 114.

J. J. Lee, S. Lim, P. Hauser and D. Hinks, *Color. Technol.,* 121 (2005) 37.

*AATCC Technical Manual*, vol 75 (Research Triangle Park: American Association of Textile Chemists and colorists, 2000).

*American Standard Test Method D* 2180–89 (West Conshohocken: ASTM International, 2003).

J. K. Grime, A. D. Clauss and K. A. Leslie, *Tenside Surf. Det.,* 29 (1992) 23.

M. B. Smith and J. March, *March's Advanced Organic Chemistry: Reactions, Mechanisms, and Structure,* 5th ed. (New York: Wiley, 2001) 291.

D. A. Skoog, F. J. Holler and T. A. Nieman, *Principles of Instrumental Analysis,* 5th ed. (Stamford: Brooks Cole, 1998), 739.

U.S. Pat. No. 5,460,747 for MULTIPLE-SUBSTITUTED BLEACH ACTIVATORS to Gosselink et al.;

U.S. Pat. No. 5,534,179 for DETERGENT COMPOSITIONS COMPRISING MULTIPERACID-FORMING BLEACH ACTIVATORS to Miracle et al.; and U.S. Pat. No. 5,686,015 for QUATERNARY SUBSTITUTED BLEACH ACTIVATORS to Willey et al.

It will be understood that various details of the presently disclosed subject matter can be changed without departing from the scope of the presently disclosed subject matter. Furthermore, the foregoing description is for the purpose of illustration only, and not for the purpose of limitation.

What is claimed is:

1. A cationic bleach activator of Formula (I):

(I)

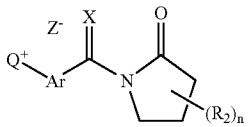

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent.

2. The cationic bleach activator of claim 1, wherein Q is:

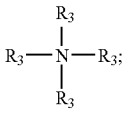

wherein each $R_3$ is independently selected from the group consisting of H, alkyl, substituted alkyl, branched alkyl, cycloalkyl, alkylene, hydroxyalkyl, alkoxyalkyl, aryl, substituted aryl, aralkylene, and aralkyl, or two or more $R_3$ groups together represent a alkyl, aralkyl, alkylene, or aralkyene group; provided that at least one $R_3$ group is an alkylene or aralkylene group that is covalently attached to the Ar moiety of the compound of Formula (I).

3. The cationic bleach activator of claim 2, wherein X is O, three $R_3$ groups are alkyl and one $R_3$ group is alkylene, and the cationic bleach activator has the following chemical structure:

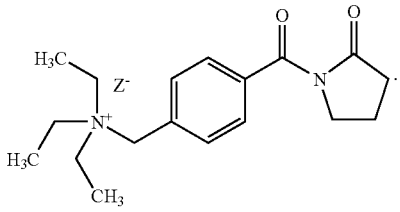

4. A bleaching composition comprising:

(a) from about 0.1% to about 70% by weight of the composition of a source of hydrogen peroxide; and (b) an effective amount of a cationic bleach activator of Formula (I):

(I)

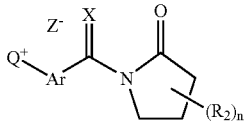

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent.

5. The bleaching composition of claim 4, wherein the cationic bleach activator of Formula (I) has the following chemical structure:

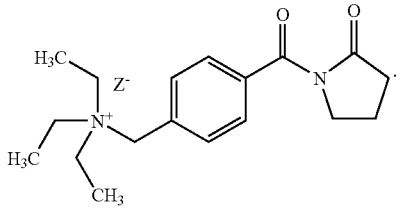

6. The bleaching composition of claim 4, comprising:

(a) from about 0.1% to about 50% by weight of the composition of the source of hydrogen peroxide; and (b) from about 0.1% to about 50% by weight of the cationic bleach activator of the formula (I).

7. The bleaching composition of claim 4, comprising an additive selected from the group consisting of a conventional bleach activator, a transition metal containing bleach catalyst, an optical brightener, a bleach-stable thickener, a detergent builder, a detersive enzyme, a detersive surfactant, a nonionic surfactant, a low-foaming automatic dishwashing surfactant, a laundry detergent surfactant, an anionic surfactant, and combinations thereof, provided that the cationic bleach activator does not react with the anionic surfactant to form a visible precipitate at ambient temperature.

8. The bleaching composition of claim 7, wherein the conventional bleach activator is selected from the group consisting of an alkanoyloxybenzenesulfonate, tetraacetylethylenediamine, and combinations thereof.

9. The bleaching composition of claim 7, wherein the nonionic surfactant comprises an ethoxylated nonionic surfactant.

10. The bleaching composition of claim 7, comprising:

(a) from about 0.1% to about 10% of the cationic bleach activator of Formula (I);

(b) from about 0.5% to about 25% of the source of hydrogen peroxide, wherein the hydrogen peroxide source is in the form of a perborate salt or a percarbonate salt; and (c) from about 0.1% to about 7% of the low-foaming automatic dishwashing surfactant; and wherein the bleaching composition is in a granular automatic dishwashing detergent form.

11. The bleaching composition of claim 7, wherein the laundry detergent surfactant is selected from the group consisting of a sugar-derived surfactant, a sarcosinate, an amine oxide, and combinations thereof.

12. The bleaching composition of claim 7, comprising:

(a) from about 0.1% to about 10% of the cationic bleach activator;

(b) from about 0.5% to about 25% of the hydrogen peroxide source, wherein the hydrogen peroxide source is in the form of a perborate salt or a percarbonate salt; and (c) from about 0.5% to about 25% of the laundry detergent surfactant; and wherein the bleaching composition is in a granular laundry detergent form.

13. The bleaching composition of claim 7, wherein the detergent builder is selected from the group consisting of a citrate, a layered silicate, zeolite A, zeolite P, and combinations thereof.

14. A detergent composition comprising an effective amount of a cationic bleach activator of Formula (I):

(I)

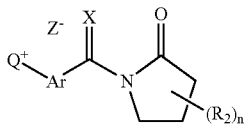

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent.

15. The detergent composition of claim 14, wherein the cationic bleach activator of Formula (I) has the following chemical structure:

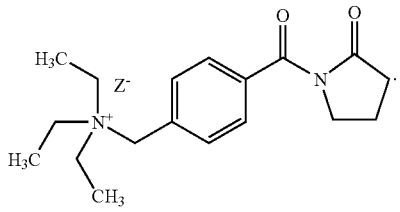

16. The detergent composition of claim 14, comprising an additive selected from the group consisting of a conventional bleach activator, a detergent builder, a detersive enzyme, a detersive surfactant, a nonionic surfactant, a low-foaming automatic dishwashing surfactant, a laundry detergent surfactant, an anionic surfactant, a fragrance, and combinations thereof, provided that the cationic bleach activator does not react with the anionic surfactant to form a visible precipitate at ambient temperature.

17. The detergent composition of claim 16, wherein the conventional bleach activator is selected from the group consisting of tetraacetylethylenediamine, nonanoyloxybenzenesulfonate, and combinations thereof.

18. The detergent composition of claim 14, wherein the detergent composition is a laundry detergent composition.

19. The detergent composition of claim 14, wherein the detergent composition is a hard surface cleaning detergent composition.

20. A method for bleaching a cellulosic fiber, the method comprising:

(a) providing one of an aqueous solution, a dispersion, and a slurry comprising a bleaching composition comprising:

(i) from about 0.1% to about 70% by weight of the composition of a source of hydrogen peroxide; and (ii) an effective amount of a cationic bleach activator of the formula (I):

(I)

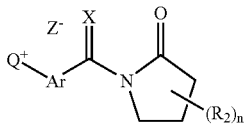

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent; and (b) contacting a cellulosic fiber with the one of an aqueous solution, a dispersion, and a slurry comprising the bleaching solution for a period of time.

21. The method of claim 20, wherein the cationic bleach activator of Formula (I) has the following chemical structure:

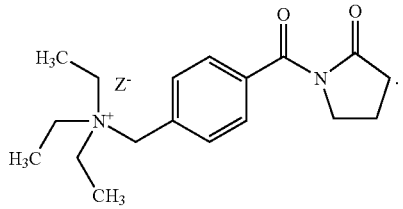

22. The method of claim 20, wherein the cellulosic fiber is selected from the group consisting of a cotton fiber and paper.

23. A method for removing a stain or discoloration from an article, the method comprising:

(a) providing one of an aqueous solution, a dispersion, and a slurry comprising a bleaching composition comprising:

(i) from about 0.1% to about 70% by weight of the composition of a source of hydrogen peroxide; and (ii) an effective amount of a cationic bleach activator of the formula (I):

(I)

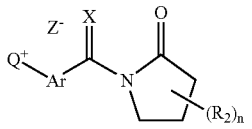

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent; and (b) contacting an article having the stain or discoloration with the one of an aqueous solution, a dispersion, and a slurry comprising the bleaching solution for a period of time.

24. The method of claim 23, wherein the cationic bleach activator of Formula (I) has the following chemical structure:

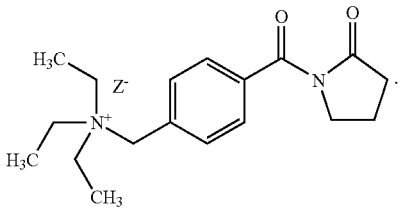

25. The method of claim 23, wherein the article having the stain or discoloration is selected from the group consisting of a fabric, dishware, a hard surface, and combinations thereof.

26. A method for oxidizing a dye in a residual dyehouse effluent, the method comprising:

(a) providing one of an aqueous solution, a dispersion, and a slurry comprising a bleaching composition comprising:

(i) from about 0.1% to about 70% by weight of the composition of a source of hydrogen peroxide; and (ii) an effective amount of a cationic bleach activator of the formula (I):

(I)

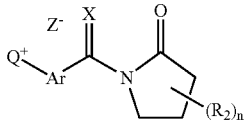

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent; and (b) contacting a residual dyehouse effluent with the one of an aqueous solution, a dispersion, and a slurry comprising the bleaching solution for a period of time to oxidize the dye in the residual dyehouse effluent.

27. The method of claim 26, wherein the cationic bleach activator of Formula (I) has the following chemical structure:

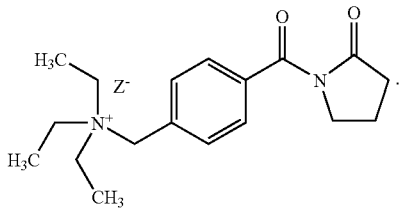

28. A method for bleaching a chemically sensitive material, the method comprising:

(a) providing one of an aqueous solution, a dispersion, and a slurry comprising a bleaching composition comprising:

(i) from about 0.1% to about 70% by weight of the composition of a source of hydrogen peroxide; and (ii) an effective amount of a cationic bleach activator of the formula (I):

(I)

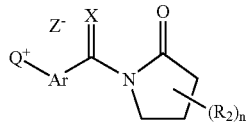

wherein:

n is an integer from 0 to 3;

$Q^+$ is a quaternary nitrogen group;

Ar is an aryl group or a substituted aryl group;

X is selected from the group consisting of O, S, and $NR_1$; wherein $R_1$ is selected from the group consisting of H, alkyl, substituted alkyl, cycloalkyl, aryl, and substituted aryl;

each $R_2$ is independently selected from the group consisting of H, alkyl, substituted alkyl, cycloalkyl, halo, hydroxyl, alkoxyl, aryl, arylkyl, aryloxyl, substituted aryl, and aralkyloxyl; and $Z^-$ is a charge-balancing counter anion and can be present or absent; and (b) contacting a chemically sensitive material with the one of an aqueous solution, a dispersion, and a slurry comprising the bleaching solution for a period of time.

29. The method of claim 28, wherein the cationic bleach activator of Formula (I) has the following chemical structure:

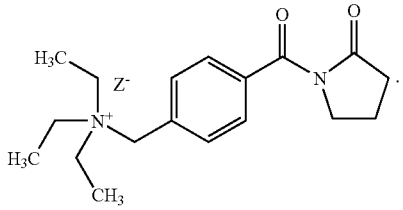

30. The method of claim 20, wherein the chemically sensitive material is selected from the group consisting of wool, a man-made cellulosic fiber, and a fiber blend.

* * * * *